US005582105A

United States Patent [19]

Miki et al.

[11] Patent Number: 5,582,105

[45] Date of Patent: Dec. 10, 1996

[54] STAMP DEVICE INCLUDING A STAMP UNIT HAVING A PRINT FACE PORTION FORMED OF A HEAT SENSITIVE STENCIL PAPER AND A PERFORATION PROCESS THEREFOR

[75] Inventors: Takashi Miki, Toyoake; Teruo Imamaki, Kasugai, both of Japan

[73] Assignee: Brother Kogyo Kabushiki Kaisha, Nagoya, Japan

[21] Appl. No.: 337,215

[22] Filed: Nov. 7, 1994

[30] Foreign Application Priority Data

Nov. 30, 1993 [JP] Japan ..... 5-329657

[51] Int. Cl.[6] ..... B41C 1/14

[52] U.S. Cl. ..... 101/128.4; 101/125

[58] Field of Search ..... 101/117, 118, 101/121, 119, 120, 122, 125, 126, 127, 127.1, 128, 128.1, 128.21, 128.4, 103, 109, 327, 333, 405, 406, 487

[56] References Cited

U.S. PATENT DOCUMENTS

| | | | |
|---|---|---|---|
| 4,996,921 | 3/1991 | Hong | 101/333 |
| 5,184,549 | 2/1993 | Imamaki et al. | 101/121 |
| 5,253,581 | 10/1993 | Miki et al. . | |
| 5,285,725 | 2/1994 | Imamaki et al. . | |
| 5,295,753 | 3/1994 | Godo et al. | 400/612 |
| 5,329,848 | 7/1994 | Yasui et al. | 101/121 |
| 5,454,309 | 10/1995 | Fujikawa et al. | 101/127.1 |
| 5,463,947 | 11/1995 | Taira | 101/125 |
| 5,483,880 | 1/1996 | Seo et al. | 101/125 |

FOREIGN PATENT DOCUMENTS 0562761 9/1993 European Pat. Off. .

*Primary Examiner*—Ren Yan
*Attorney, Agent, or Firm*—Oliff & Berridge

[57] ABSTRACT

A stamp device includes a stamp unit that can be designed in a compact size, of a light weight and having a low manufacturing cost while preventing ink leakage, and a thermal perforating device that perforates the print face of the stamp unit. The stamp unit includes a grip portion, a stamp unit that is fixedly linked to the grip portion, a skirt member covering the outer peripheral side of the stamp unit, and a protection cap that is freely detachably mounted on the stamp unit. The thermal perforating device for perforating the print face portion of the stamp unit includes a body frame, a keyboard that is provided at the front portion of the body frame and serves to input a perforation character array, a liquid crystal display for displaying the input character array, a thermal perforating unit provided at the rear portion of the body frame and into which the stamp unit is inserted, and a control unit provided inside of the body frame.

16 Claims, 21 Drawing Sheets

Fig.24B

| ITEM | INSTRUCTIONS |
|---|---|
| S1 | CONTACTLESS SWITCH SIGNAL READ IN |
| S2 | DOES STAMP UNIT EXIST ? |
| S3 | " PLEASE DETACH STAMP UNIT" IS DISPLAYED ON LCD |
| S4 | THERMAL PERFORATING DEVICE IS INITIALIZED AND " IN PREPARATION" IS DISPLAYED ON LCD |
| S5 | INPUT SETTING OF PRINT CONTENT<br>·PRINT FACE SIZE INDICATION<br>·FORMAT INPUT<br>·PERFORATION CHARACTER ARRAY DATA INPUT |
| S6 | MESSAGE OF " PLEASE MOUNT STAMP UNIT" IS DISPLAYED ON LCD |
| S7 | PERFORATION SWITCH ON ? |
| S8 | CONTACTLESS SWITCH SIGNAL READ IN |

Fig.25B

| ITEM | INSTRUCTIONS |
|---|---|
| S9 | DOES STAMP UNIT EXIST ? |
| S10 | "PLEASE MOUNT STAMP UNIT" IS DISPLAYED ON LCD |
| S11 | IS STAMP UNIT SIZE CONFORMABLE ? |
| S12 | "PLEASE SUBSTITUTE STAMP UNIT" IS DISPLAYED ON LCD |
| S13 | CONDUCT PERFORATION ON PRINT FACE PORTION OF STAMP UNIT, "UNDER PERFORATION" IS DISPLAYED ON LCD |
| S14 | PERFORATION FINISHED ? |
| S15 | "PERFORATION PROCESS IS FINISHED" AND "PLEASE DETACH STAMP UNIT" ARE DISPLAYED ON LCD |

STAMP DEVICE INCLUDING A STAMP UNIT HAVING A PRINT FACE PORTION FORMED OF A HEAT SENSITIVE STENCIL PAPER AND A PERFORATION PROCESS THEREFOR

BACKGROUND OF THE INVENTION

1. Field of the Invention

This invention relates to a stamp device, and particularly to a stamp device including a stamp member having a print face portion that is formed of a heat sensitive stencil paper.

2. Description of the Related Art

There has been conventionally utilized various kinds of stamps each of which serves to print a company name, an address or other character arrays on the surface of a sheet and has a print face portion formed of rubber.

Usually, this type of stamp is individually made to order. Hence, they are expensive and a user must wait for a long time to receive them from an order.

On the other hand, a heat sensitive stencil paper has been conventionally used for printing in which a desired pattern can be perforated by irradiation of infrared rays or a thermal head, and ink is transmitted through a perforation array to print various kinds of patterns of character arrays, figures, marks or the like.

In U.S. Pat. No. 5,285,725, the applicant of the present application proposed a stencil plate that mainly contains a heat sensitive stencil paper as described above and an impregnation member impregnated with ink. The stencil plate is suitable to prepare a stamp in place of the conventional stamp having the print face portion formed of rubber as described above.

The stencil plate is formed as follows. An impregnation member impregnated with ink and a frame member surrounding the impregnation member are adhesively attached to a synthetic resin film, and a heat sensitive stencil paper is adhesively attached onto the surfaces of the impregnation member and the frame member.

When the stencil plate as described above is applied to a stamp, the stencil plate is adhesively attached to the lower surface of the base portion of a stamp member having a grip portion through a cushion member, and a desired pattern of a character array or the like is perforated on a heat sensitive paper by irradiation of infrared rays or a thermal head. With this construction, a stamp that comprises a stamp member and a stencil plate and can print the desired character-array pattern or the like on sheets over many times can be obtained.

In U.S. Pat. No. 5,253,581, the applicant of the present application proposed a stamp device comprising a stamp member and a thermal perforating device for perforating the print face portion of the stamp member.

The stamp member comprises a grip portion, a body case, a supply reel and a take-up reel that are accommodated in the body case and serve to supply and wind a tape-shaped heat sensitive stencil paper, and an ink pad for supplying ink to perforated portions of the heat sensitive stencil paper.

The thermal perforating device includes a perforation mount portion on which the stamp member is freely detachably mounted, a feed mechanism for feeding the heat sensitive stencil paper of the stamp member, a thermal head for perforating the heat sensitive stencil paper of the stamp member, a key board for inputting characters or symbols, and a controller for controlling the feed mechanism and the thermal head so that the heat sensitive stencil paper is perforated to form a character array that is input on the basis of input data.

According to the stamp device, the heat sensitive stencil paper is provided in a tape shape to the stamp member, and the print face portion of the stamp member is perforated by the thermal perforating device to form a desired character-array pattern so that different patterns can be perforatively formed on the print face portion as desired. Further, since ink is automatically supplied to the print face portion from the ink pad in the stamp member during a print operation, the print operation can be performed without coating external ink to the print face portion.

The stamp member as disclosed in the U.S. Pat. No. 5,253,581 is provided with the tape-shaped long heat sensitive stencil paper. However, in usual cases, only a part of the heat sensitive stencil paper is used, and thus, it is vainly wasted. Further, since the tape-shaped long heat sensitive stencil paper, the supply reel, the take-up reel, etc. are accommodated in the stamp member, the stamp member becomes large in size, and it is difficult to use. In addition, a manufacturing cost thereof is high. Still further, since the tape-shaped heat sensitive stencil paper is kept in contact with the ink pad, a sealing to prevent leakage of the ink from the ink pad is difficult, and the leakage of the ink is liable to occur.

SUMMARY OF THE INVENTION

An object of this invention is to provide a stamp device including a stamp unit that can be compact in size, light weight and manufacturable at a low cost while preventing leakage of ink and to provide a thermal perforating device for perforating the print face portion of the stamp unit.

This and other objects are achieved by providing a stamp device including a stamp unit and a thermal perforating device for thermally perforating a print face portion of the stamp unit to form a dot pattern. The stamp unit includes a grip portion and a stencil plate that is fixed to the grip portion and that contains an ink member and a heat sensitive stencil paper fixedly covering the surface of the ink member to form the print face portion. The thermal perforating device includes a perforation mount portion on which the stamp unit is freely detachably mounted, an input mechanism for inputting characters or symbols, a data storing device for storing input data input from the input mechanism, a perforating device containing a thermal head for forming a dot pattern by perforating the print face portion of the stamp unit mounted on the perforation mount portion, and a controller for receiving the input data from the data storing device to control the driving of the perforating device. The ink member may be an impregnation member impregnated with ink.

In the stamp device as explained above, when characters or symbols are input from the input mechanism in a state where the stamp unit is mounted on the perforation mount portion of the thermal perforating device, the input data are stored in the data storing device, and the controller receives the input data from the data storing device to control driving of the perforating device containing the thermal head, whereby the print face portion of the stamp unit is perforated in a dot form.

Next, the stamp unit is taken out from the perforation mount portion of the thermal perforating device, and the grip portion of the stamp unit is grasped by hand to press the stencil plate against the surface of a sheet so that the ink in the ink member of the stencil plate oozes out through pores on the heat sensitive stencil paper constituting the print face portion, thereby printing a pattern of the input characters or the like on the sheet.

As described above, according to the stamp unit of this invention, the print face portion of the stamp unit is perforated in a dot shape to form a desired dot pattern by the thermal perforating device, whereby a stamp unit that is similar to a rubber stamp and can print without coating ink can be obtained.

The stencil plate of the stamp unit is fixed to the grip portion, and the stencil plate includes the impregnation member impregnated with ink and the heat sensitive stencil paper that fixedly covers the surface of the impregnation member and constitutes the print face portion so that the stencil plate can be designed in a simple, compact and light construction, and the manufacturing cost of the stamp unit can be reduced.

Further, the heat sensitive stencil paper is designed to fixedly cover the surface of the impregnation member impregnated with ink so that the ink is prevented from leaking to the outside of the print face portion.

When the ink member is formed of the impregnation member impregnated with ink the ink can be supplied, neither excessively nor insufficiently, during the printing operation for a long time.

BRIEF DESCRIPTION OF THE DRAWINGS

Other objects and advantages of the invention will become apparent from the following detailed description of preferred embodiments when taken in conjunction with the accompanying drawings, in which:

FIG. 24(B) is part of a flowchart for a perforation process by the thermal perforating device;

FIG. 25(B) is part of the flowchart for the perforation process by the thermal perforating device.

DETAILED DESCRIPTION OF PREFERRED EMBODIMENTS

An embodiment according to this invention will be described with reference to the accompanying drawings.

Figure 9:
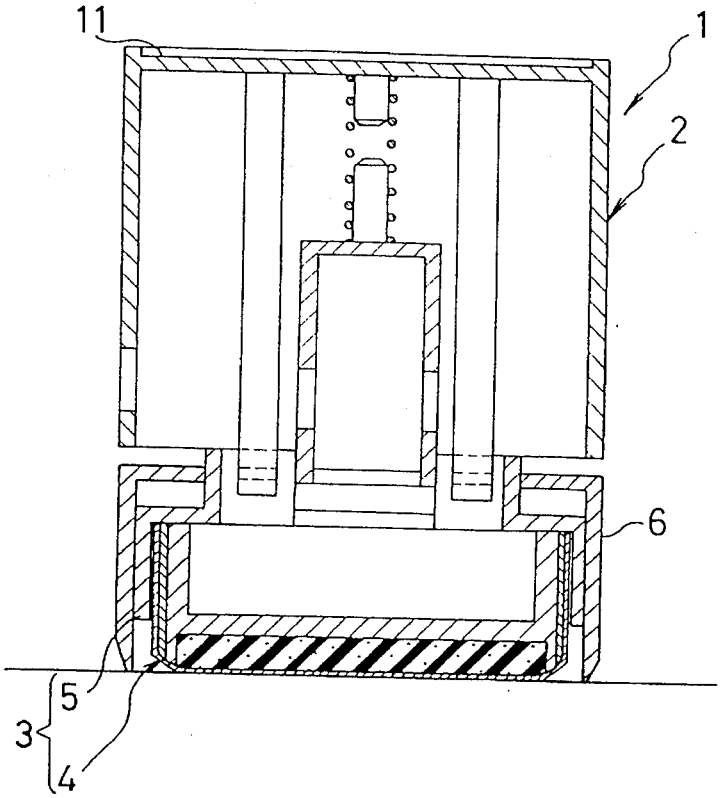
FIG. 9 is a longitudinal sectional front view of the stamp unit when the skirt member is at the second position.
Figure 10:
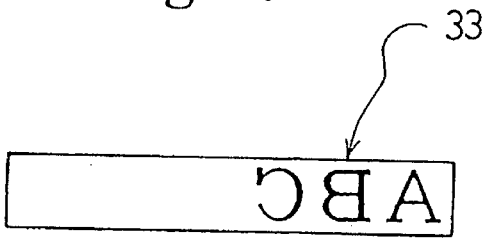
FIG. 10 is a diagram showing an example of a pattern to be formed by perforating the print face portion of the stamp unit.
Figure 11:
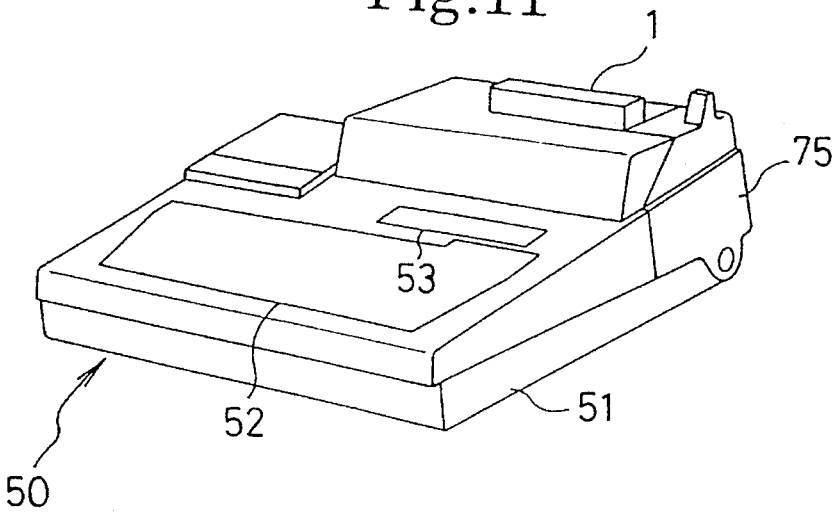
FIG. 11 is a perspective view of a thermal perforating device of the stamp device.
Figure 12:
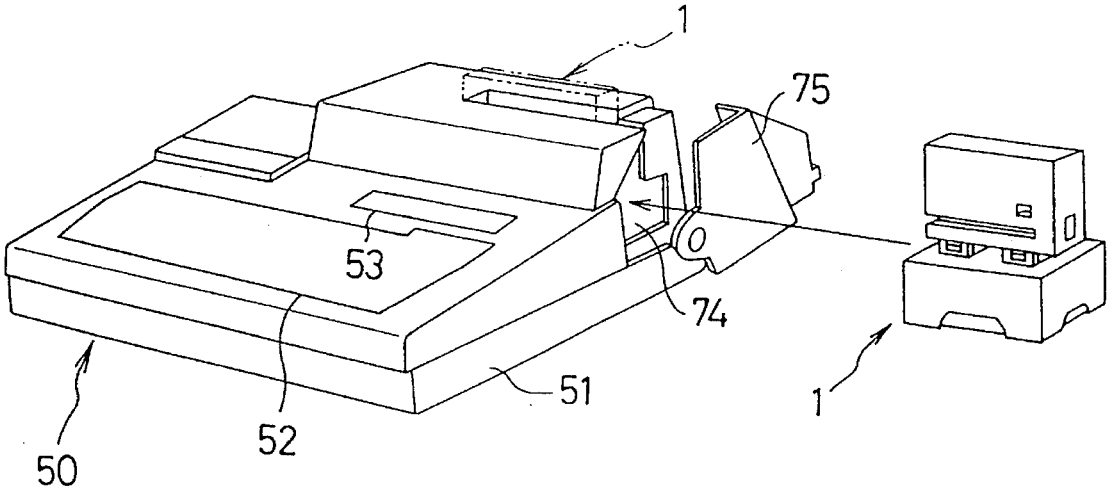
FIG. 12 is a perspective view of the thermal perforating device and the stamp unit.

The stamp device of this embodiment comprises a stamp unit 1 shown in FIGS. 1 to 10 and a thermal perforating device 50 shown in FIG. 11 and figures subsequent thereto.

First, the stamp unit 1 will be described with reference to FIGS. 1 to 10.

As shown in FIGS. 1 to 4, the stamp unit 1 includes a grip portion 2 that is grasped by a hand, a stamp member 3 that is fixedly linked to the grip portion 2, a skirt member 6 covering the outer peripheral side of the stamp member 3, and a protection cap 7 that is freely detachably mounted on the stamp member 3.

The grip portion 2 comprises a hollow member having a rectangular parallelopiped shape, which is formed of metal or synthetic resin material and whose lower end is opened. A recess portion 11 onto which a label 10 is attached is formed at the top portion of the grip portion 2, and a pair of engaging pawls 14 that project downwardly is provided at each of the lower end portions of the front wall 12 and the rear wall 13 of the grip portion 2. A guide groove 15 is formed at each of the lower portions of the front wall 12, and the rear wall of the grip portion 2. An engaging recess 16 is formed on the front wall 12, and an engaging hole 18 is formed on the left side wall 17. A spring support portion 20 is formed at the central portion of the lower surface of the upper wall 19 inside of the grip portion 2.

The stamp member 3 comprises a stamp member body 4 and an outer-periphery holding member 5 into which the stamp body 4 is fixedly inserted from the lower side, and which covers about ⅔ of the upper portion at the outer peripheral side of the stamp member body 4 and is engaged with the four engaging pawls 14 of the grip portion 2 so that it is fixed to the grip portion 2.

The stamp member body 4 comprises a base member 26 of synthetic resin, which is designed in a rectangular parallelopiped shape having a hollow body and provided with a shallow recess portion 25 at the lower surface side thereof, an impregnation member 27 (corresponding to an ink member) mounted on the recess portion 25 and impregnated with oil ink, and a heat sensitive stencil paper 28 that covers the lower surface of the impregnation member 27 and the outer peripheral side of the base member 26 and is adhesively attached to the outer peripheral surface of the base member 26 with adhesive agent 29. The impregnation member 27 may be adhesively attached to the recess portion 25 of the base member 26 with adhesive agent or the like.

The base member 26 is formed of a synthetic resin material having an excellent oil-proof property (for example, vinyl chloride, polypropylene, polyethylene, polyacetal, polyethylene terephthalate or the like) or metal material as it is contacted with the oil ink. The impregnation member 27 is mounted on the recess portion 25 of the base member 26, thereby preventing positional deviation of the impregnation member 27 and also preventing flow-out of ink from the impregnation member 27.

The impregnation member 27 comprises an elastic foaming member that is formed of synthetic material (for example, polyethylene, polypropylene, polyethylene terephthalate, polyurethane, acrylonitrile-butadiene rubber), or non-woven fabric. The impregnation member 27 is impregnated with ink in a saturated state, and by pressing the impregnation member 27, the ink oozes out from the impregnation member.

Figure 6:
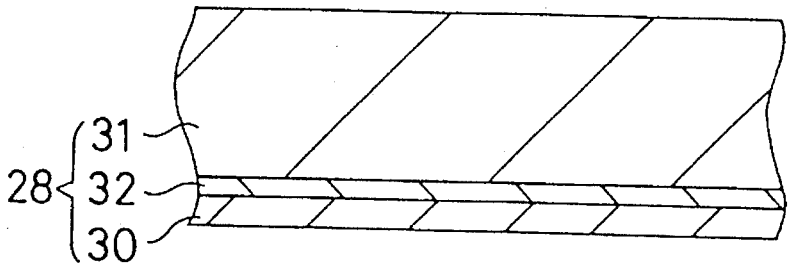
FIG. 6 is an enlarged cross-sectional view of a heat sensitive stencil paper of the stamp unit.

As shown in FIG. 6, the heat sensitive stencil paper 28 comprises a thermoplastic film 30, a porous carrier 31 and an adhesive layer 32 through which the thermoplastic film 30 and the porous carrier 31 are adhesively attached to each other. The thermoplastic film 30 is formed of a thermoplastic synthetic resin film (for example, polyethylene terephthalate, polypropylene, vinylidene chloride-vinyl chloride copolymer or the like) having a thickness of about 1 to 4 μm, preferably about 2 μm.

If the thickness is less than 1 μm, the manufacturing cost is increased, and its strength is reduced, resulting in poor practical use. On the other hand, if the thickness is above 4 μm, it is too thick to perforate the film with a general thermal head having a rated power of about $50mJ/mm^2$.

The porous carrier 31 is formed of a porous thin sheet of paper made primarily of a natural fiber such as (Manila hemp, kozo or mitsumata), a synthetic fiber (such as polyethylene terephthalate, polyvinyl alcohol or polyacrylonitrile), or a semi-synthetic fiber (such as rayon).

Figure 5:
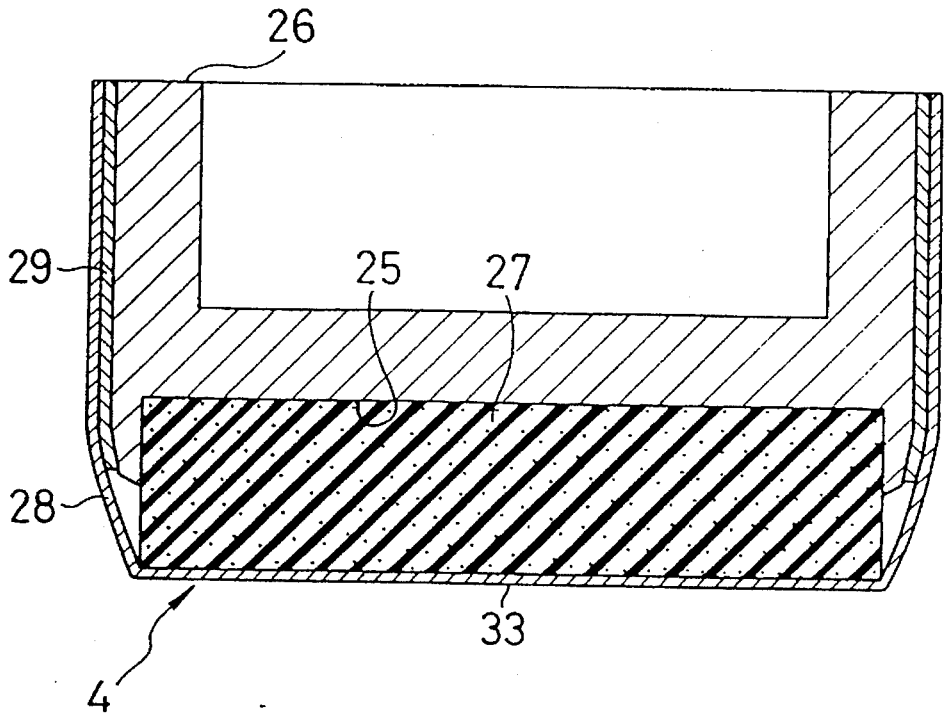
FIG. 5 is an enlarged longitudinal sectional front view of a stamp member of the stamp unit.
Figure 7:
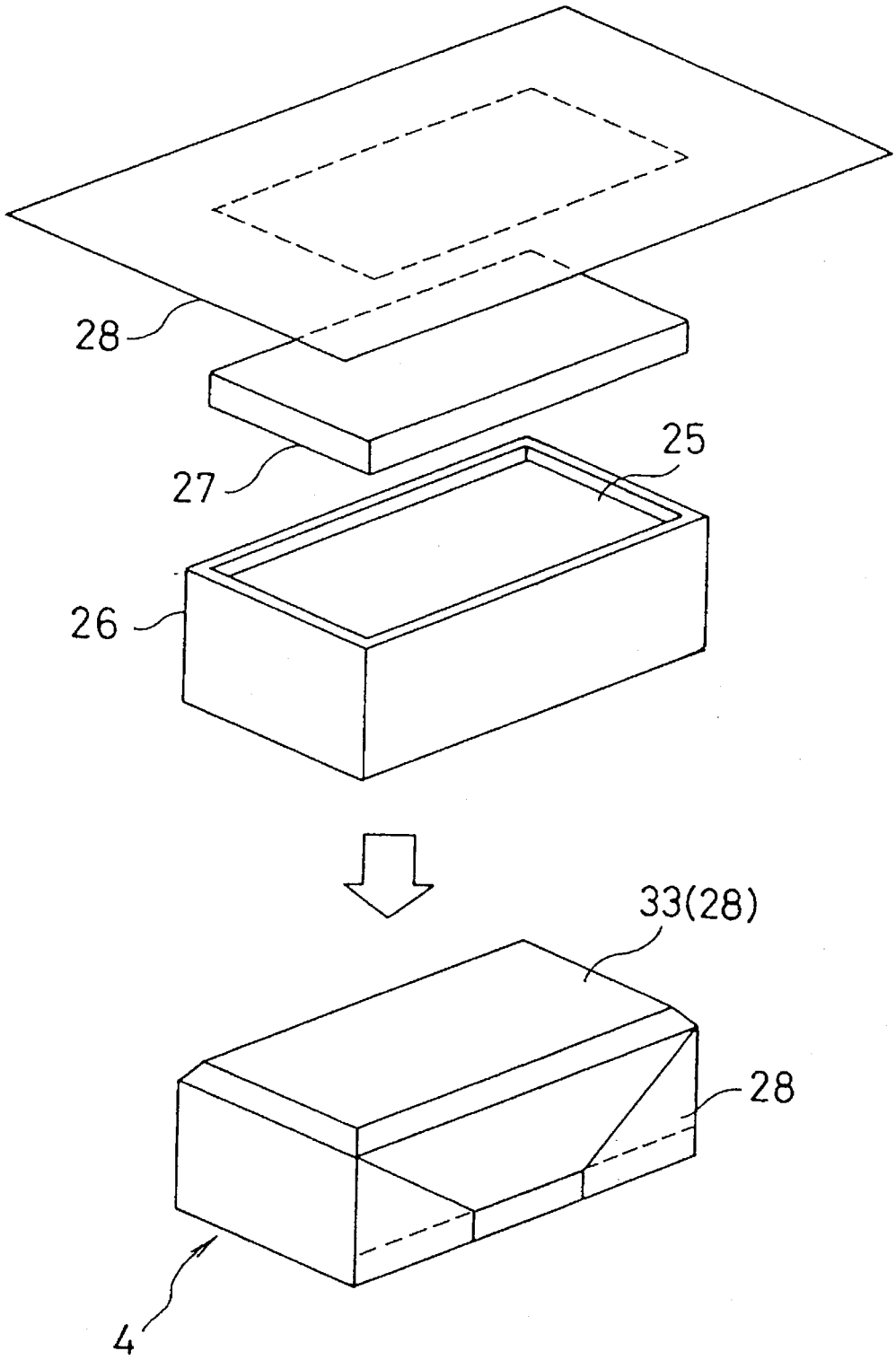
FIG. 7 is a perspective view showing a manufacturing method of the stamp member of the stamp unit.

As shown in FIGS. 5 and 7, in a state where the base member 26 is inverted, the impregnation member 27 is mounted on the recess portion 25 and then impregnated with ink. Thereafter, the impregnation member 27 is covered with the heat sensitive stencil paper 28 from its upper side so that the porous carrier 31 faces the impregnation member 27, and the heat sensitive stencil paper 28 is closely contacted with the surface of the impregnation member 27. The outer-peripheral side portion of the heat sensitive Stencil paper 28 is folded to come into close contact with the outer peripheral surface of the base member 26 and then adhesively attached thereto with an adhesive layer 29, thereby forming the stamp member body 4 shown in FIG. 7.

A portion of the heat sensitive stencil paper 28 that is closely contacted with the surface (lower surface in FIG. 5) of the impregnation member 27 serves as the print face portion 33. The outer peripheral side of the heat sensitive stencil paper 28 is contacted with the outer peripheral surface of the base member 26, and the print face portion 33 can be formed over substantially the whole area on the lower surface of the stamp member 3 so that positioning thereof can be simplified.

In order to adhesively attach the outer peripheral side portion of the heat sensitive stencil paper 28 to the outer peripheral surface of the base member 26, the adhesive layer 29 may be beforehand formed at the outer peripheral side portion of the heat sensitive stencil paper 28, the adhesive layer 29 may be beforehand formed on the outer peripheral surface of the base member 26, or both.

Figure 1:
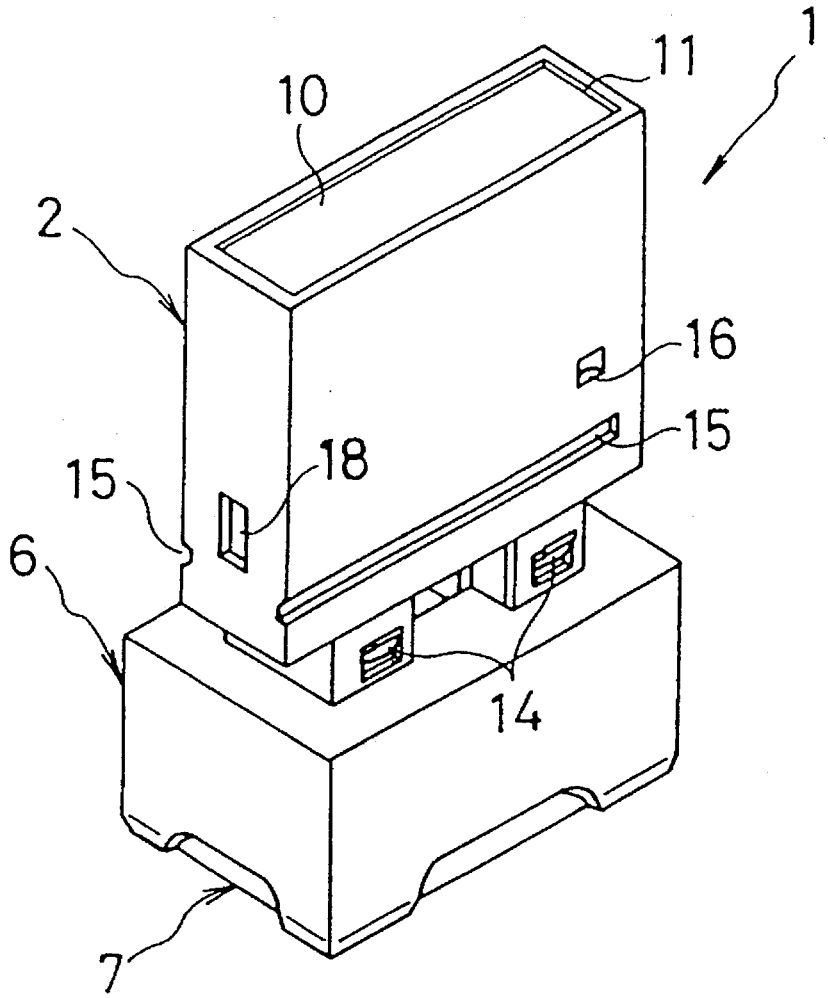
FIG. 1 is a perspective view of a stamp unit of a stamp device according to an embodiment of this invention.
Figure 2:
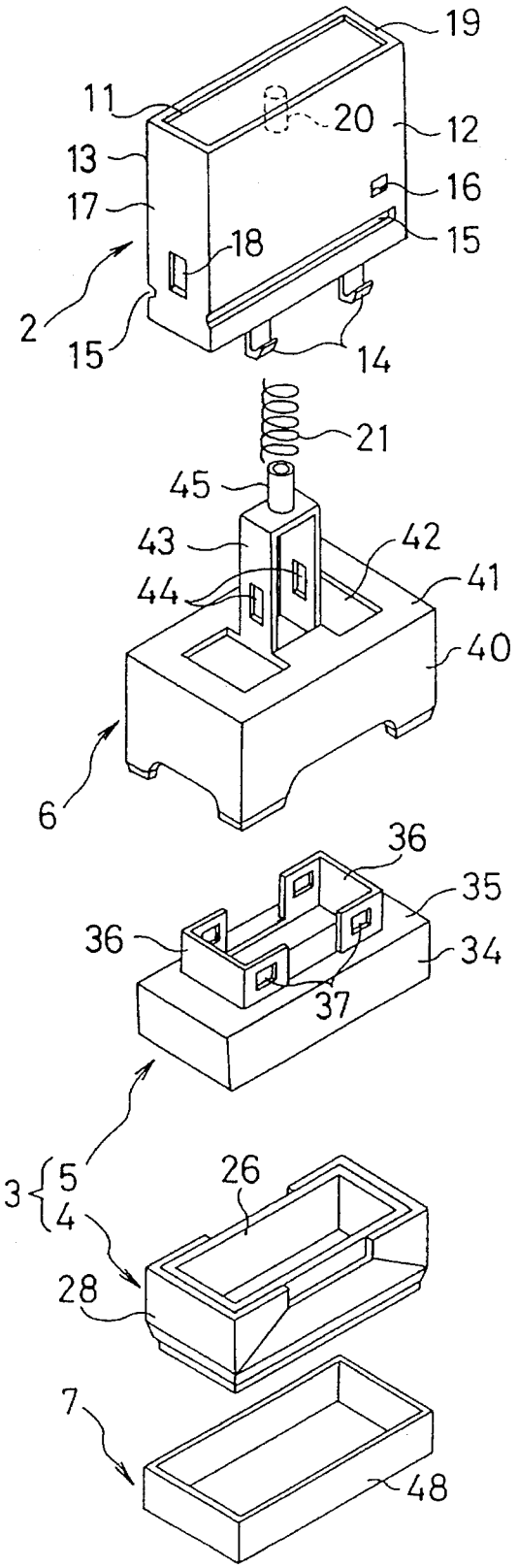
FIG. 2 is an exploded perspective view of the stamp unit.
Figure 3:
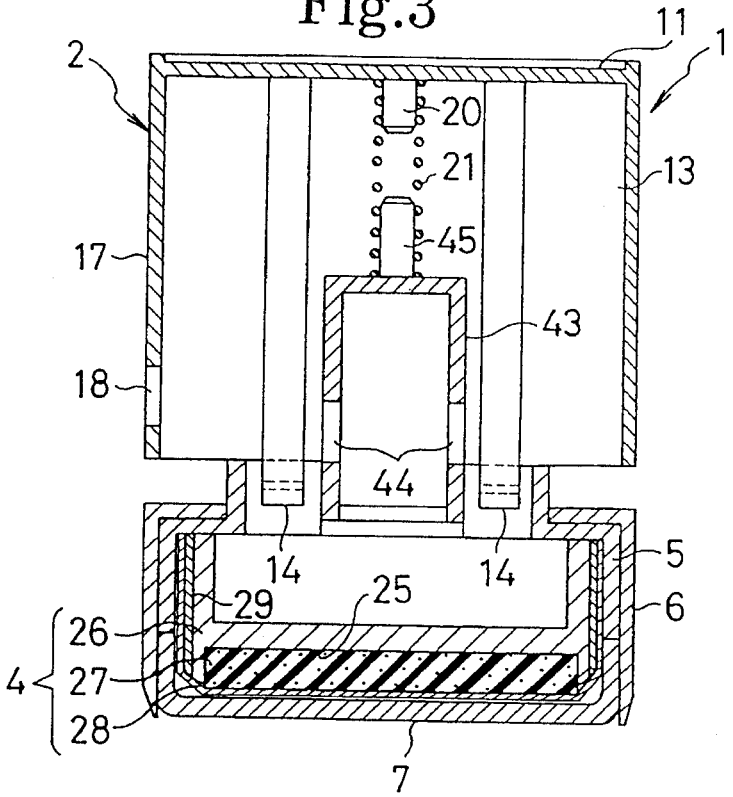
FIG. 3 is a longitudinal sectional front view of the stamp unit.
Figure 4:
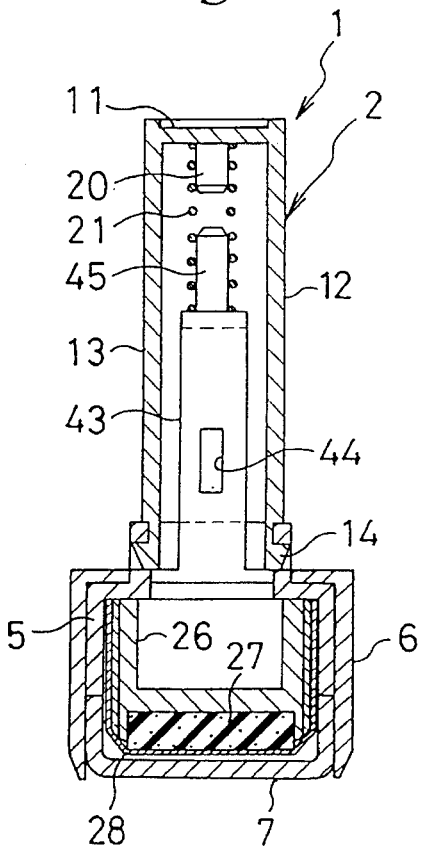
FIG. 4 is a longitudinal sectional side view of the stamp unit.

As shown in FIGS. 2 to 4, the outer-periphery holding member 5 comprises a peripheral wall portion 34 having a rectangular section that is adhesively attached to the stamp member body 4 while the stamp member body 4 is inserted inside of the peripheral wall portion 34, an upper wall portion 35, and a pair of right and left engaging wall portions 36, which project from the upper wall portion 35 by a predetermined height. Engaging holes 37, which Correspond to the four engaging pawls 14 of the grip portion 2, are formed in the pair of right and left engaging wall portions 36. The pair of right and left engaging wall portions 36 are freely slidably inserted into a pair of right and left rectangular holes on the upper wall 41 of the skirt member 6. The four engaging pawls 14 are engaged with the four engaging holes 37 of the engaging wall portions 36, and the upper ends of the engaging wall portions 36 are contacted with the lower end of the grip portion 2, whereby the outer-periphery holding member 5 is fixed to the grip portion 2.

As shown in FIGS. 2 to 4, the skirt member 6 comprises an outer-peripheral wall portion 40 having a rectangular section into which the outer-peripheral wall portion 34 of the outer-periphery holding member 5 is freely slidably inserted, an upper wall portion 41, which is at the upper end of the outer peripheral wall portion 40 and located at the upper side of the upper wall portion 35 of the outer-periphery holding member 5, a portal portion 43, which projects from the central portion of the upper wall portion 41 upwardly by a predetermined height and is insertable into the grip portion 2, and a spring support portion 45 which is projectingly provided at the central portion of the upper end of the portal portion 43.

At the lower portion of the right and left wall portions of the portal portion 43, guide holes 44 are formed at front and rear side positions corresponding to the guide holes 18. Hence, a continuous hole extends through both of the wall portions.

A spring 21 urging the skirt member 6 downwardly with respect to the grip portion 2 is mounted on the spring support portion 20 of the grip portion 2 and the spring support portion 45 of the skirt member 6. The skirt member 6 is designed to be freely moved upwardly and downwardly over a first position shown in FIGS. 3 and 4, a second position shown in FIG. 9 and a third position shown in FIG. 8, and the skirt member 6 is urged toward the first position by the spring 21. The lower end portions on the four surfaces of the outer peripheral wall 40 of the skirt member 6 are partially cut out to enable the protection cap 7 to be detached and to enable positioning of the print face portion 33.

At the first position, the upper wall portion 41 of the skirt member 6 abuts against the upper wall portion 35 of the outer-periphery holding member 5, and the lower end of the skirt member 6 projects to a position lower than the print face portion 33. At the second position, the upper wall portion 41 of the skirt member 6 is located at a position between the upper wall portion 35 of the outer-periphery holding member 5 and the lower end of the grip portion 2, and the lower end of the skirt member 6 is located at substantially the same level as the print face portion 33. At the third position, the upper wall portion 41 of the skirt member 6 abuts against the lower end of the grip portion 2, and the lower end of the skirt member 6 is located at a position higher than the print face portion 33. A stroke of the skirt member 6 from the first position to the second position is preferably set to about 5 mm.

The protection cap 7 is freely detachably disposed so as to cover the lower end side of the stamp member body 4, thereby protecting the stamp unit body, and the outer wall portion 48 thereof is designed in the same sectional shape as the outer peripheral wall 34 of the outer-periphery holding member 5. The protection cap 7 is engagedly inserted into the inner portion of the outer peripheral wall portion 40 of the skirt member 6 and supported thereby.

As shown in FIGS. 3 and 4, when the protection cap is mounted, the upper end thereof abuts against the lower end of the outer peripheral wall 34, a small gap occurs between the protection cap 7 and the print face portion 33, and the protection cap 7 is supported by a frictional force between the outer peripheral surface of the outer peripheral wall portion 48 and the inner peripheral surface of the outer peripheral wall portion 40 of the skirt member 6. Therefore, even when the grip portion 2 is downwardly pressed in the state where the protection cap 7 is mounted, the gap is maintained due to the abutment between the upper end of the protection cap 7 and the lower end of the outer peripheral wall 34, and thus, no ink is transferred to the protection cap 7.

For example, as shown in FIG. 10, dot-pattern pores of a pattern, which is formed of a character array of a mirror image of "ABC" and rectangular frame surrounding the outer side of the character array, are formed by a thermal head 90 as described later on the print face portion, thereby designing a stamp member capable of printing a character array of a mirror image of the pattern of FIG. 10, "ABC" and the rectangular frame. Accordingly, like an ordinary stamp having a print face portion formed of rubber, the pattern as described above can be printed over about 1000 times, for example. As is well known, the perforation may be performed by irradiation of infrared rays in place of the thermal head.

When the heat sensitive stencil paper 28 serving as the print face portion 33 is perforated, the stamp unit 1 is mounted on the perforation mount portion 71 of the thermal perforating device 50 as described later, and a guide bar 83 thereof is inserted through guide holes 18, 44, 44 to keep the skirt member 6 at the third position so that perforation can be performed. Further, when the device is unused, the protection cap 7 is mounted, and as shown in FIGS. 3 and 4, the skirt member 6 is maintained at the first position. When a print is performed, the protection cap 7 is detached, and the skirt member 6 is maintained at the first position to position the skirt member 6 to a printing position on the surface of a sheet, thereby positioning the print face portion 33 of the stamp member 3. Thereafter, the grip portion 2 is downwardly pressed to perform the print as shown in FIG. 9.

Next, the thermal perforating device 50 will be described.

As shown in FIGS. 11 to 15, the thermal perforating device 50 includes a body frame 51, a keyboard 52 and a liquid crystal display 53, which are provided at the front portion of the body frame 51, a thermal perforating unit 54 provided at the rear portion of the main frame 51, and a control unit 55 provided inside of the body frame 51.

On the keyboard 52 are provided character and symbol keys 56 for a plurality of characters and symbols, which are used as both of a Japanese Kana Keys and an alphabet keys, various function keys, such as cursor moving keys 57, an execution key 58, a line feed key 59, a determine/end key 60, a cancel key 61, a delete key 62, a shift key 63, a small-letter key 64, a letter kind setting key 65, and a perforation switch 66,) and a main switch 67.

The liquid crystal display device 53 is designed to display character arrays of plural lines corresponding to a pattern that is a print target to be printed by the stamp unit 1.

Next, the thermal perforating unit 54 will be described.

As shown in FIGS. 13 to 22, the thermal perforating unit 54 includes a perforation mount portion 71 on which the stamp unit 1 is detachably mounted, a thermal perforating mechanism 72 for perforating the print face portion 33 of the stamp unit 1 mounted on the perforation mount portion 71 in a dot form, etc.

The perforation mount portion 71 will be described. As shown in FIGS. 14 to 17, a right side wall 73 of a subframe 70 is formed with an opening 74 that has substantially the same shape as the side surface shape of the lower half portion of the stamp unit 1, having the longest width in a front-and-rear direction of the stamp member 3, and a sector gear 76 is fixedly provided to an opening and closing door 75 for opening and closing the opening 74. The opening and closing door and the sector gear 76 are freely rotatably pivoted on the right side wall 73 by a pivot shaft 77 in the right-and-left direction. The upper portion of the subframe 70 is provided with a pair of parallel guide members 78 and 79 at the front and rear sides thereof, and the lower ends of the guide members 78 and 79 are provided with guide portions 80 that extend horizontally in parallel to each other in the right-and-left direction so as to face each other.

Figure 16:
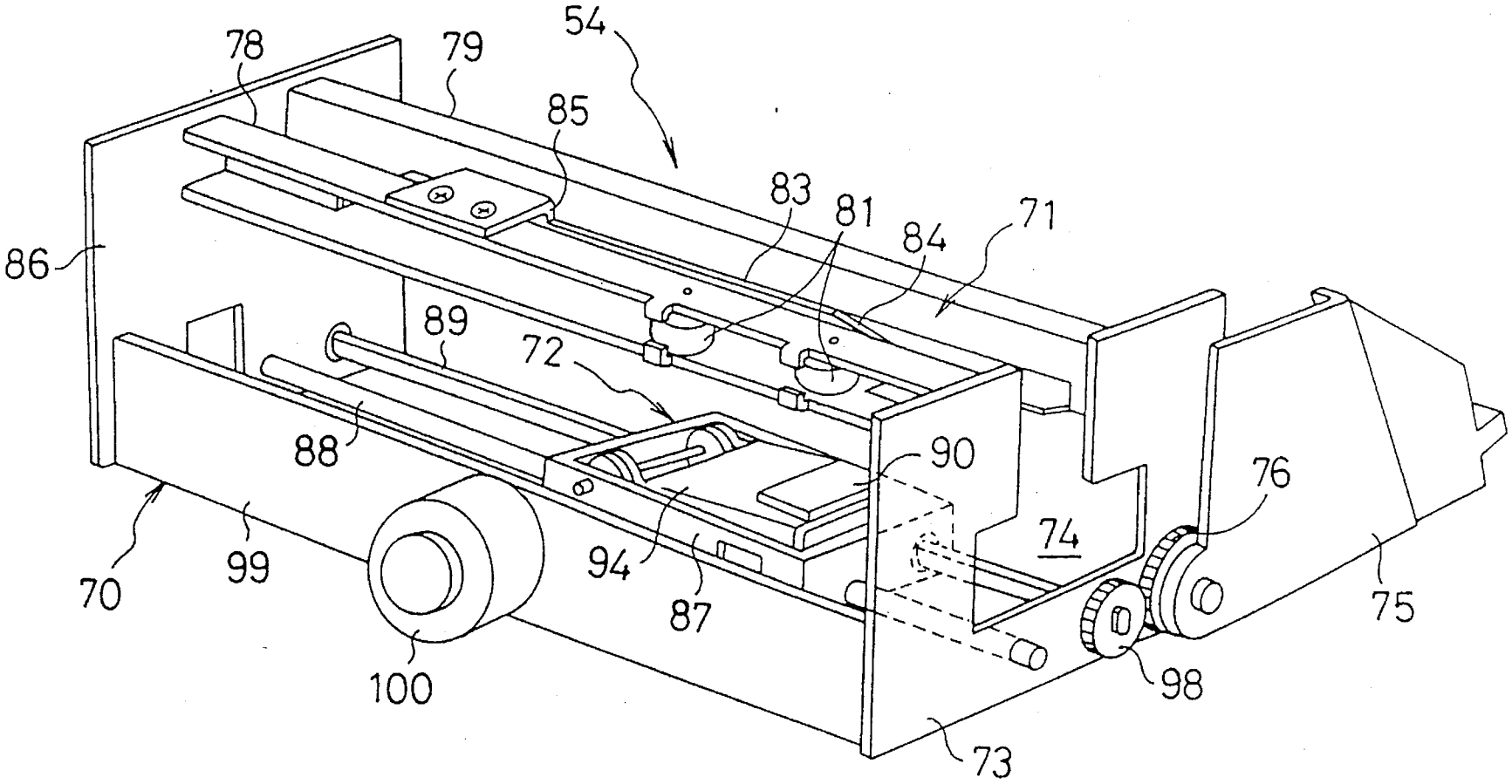
FIG. 16 is a perspective view showing a thermal perforating unit of the thermal perforating device.
Figure 17:
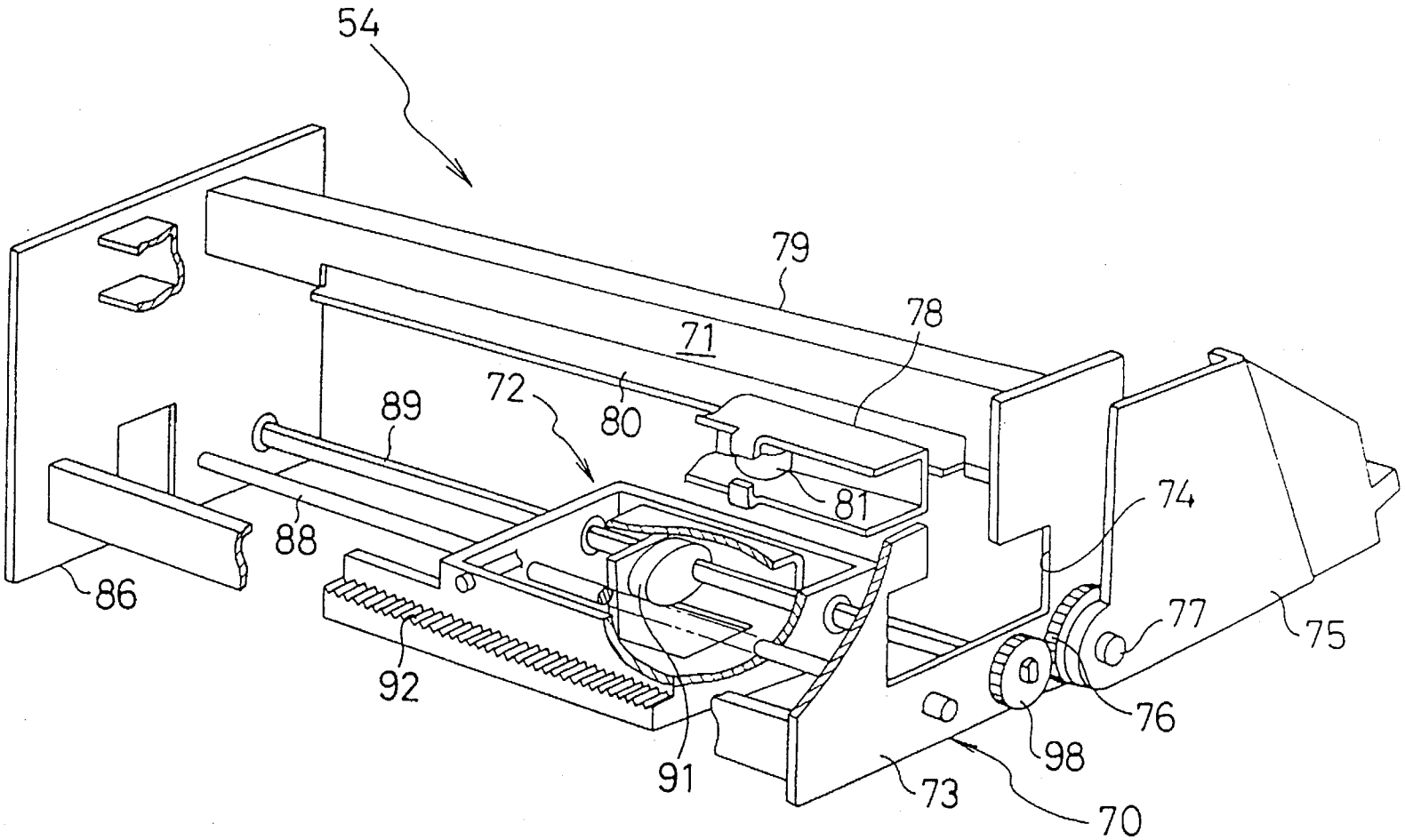
FIG. 17 is a perspective partially cut away view of a main part of the thermal perforating unit of the thermal perforating device.
Figure 18:
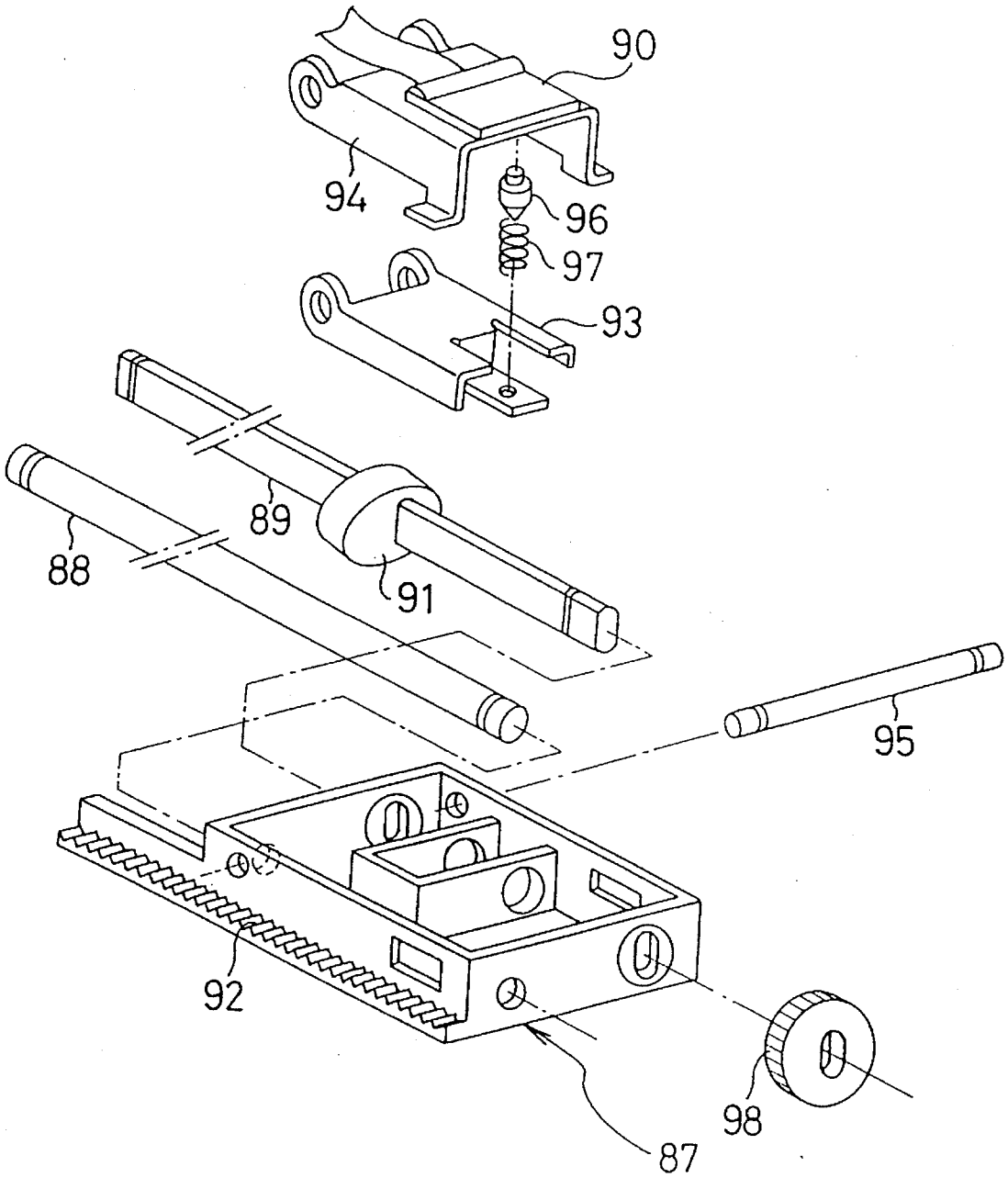
FIG. 18 is an exploded perspective view of the thermal perforating mechanism.

A pair of right and left rollers 81 are disposed in communication with the guide member 78 through an elongated hole so as to be movable in the front-and-rear direction of FIG. 16 by a short distance. Rollers 81 are urged rearwardly by the spring 82.

Figure 20:
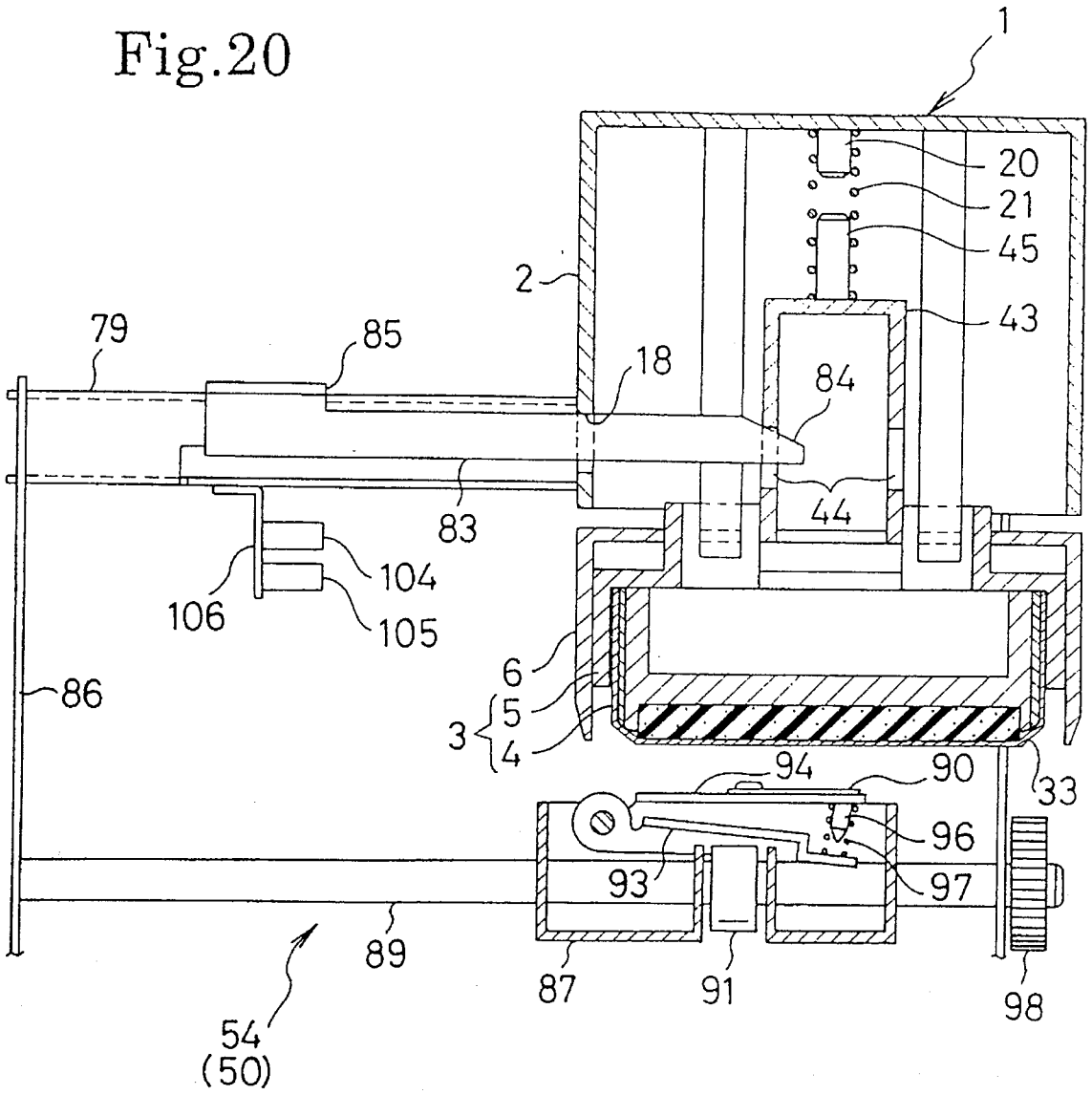
FIG. 20 is a longitudinally sectional front view of the stamp unit that is mounted on the perforation mount portion and the thermal perforating unit.

The guide bar 83 fixed to the guide member 78 at the front side is disposed at a middle position between the guide members 78 and 79. A tapered face 84, which inclines in a lower right direction, is formed on the upper surface of the right end portion of the guide bar 83 as shown in FIGS. 16 and 20, and an engaging portion 85 for defining the left limit position of the stamp unit 1 is formed at the left end portion of the guide bar 83.

The stamp unit 1 is inserted through the opening 74, and the pair of front and rear guide members 80 are engaged with the pair of front and rear guide grooves 15 of the grip portion 2 of the stamp unit 1, whereby the stamp unit 1 is supported by the pair of guide members 80, and the stamp unit 1 is urged rearwardly through the pair of rollers 81 by the spring 82 to be accurately positioned in the front and rear direction. Further, in a state where the stamp unit 1 abuts against the engaging portion 85, and the roller 81 at the right side is engaged with the engaging recess portion 16 of the grip portion 2, the position of the stamp unit 1 in the right and left direction can be accurately set.

Figure 8:
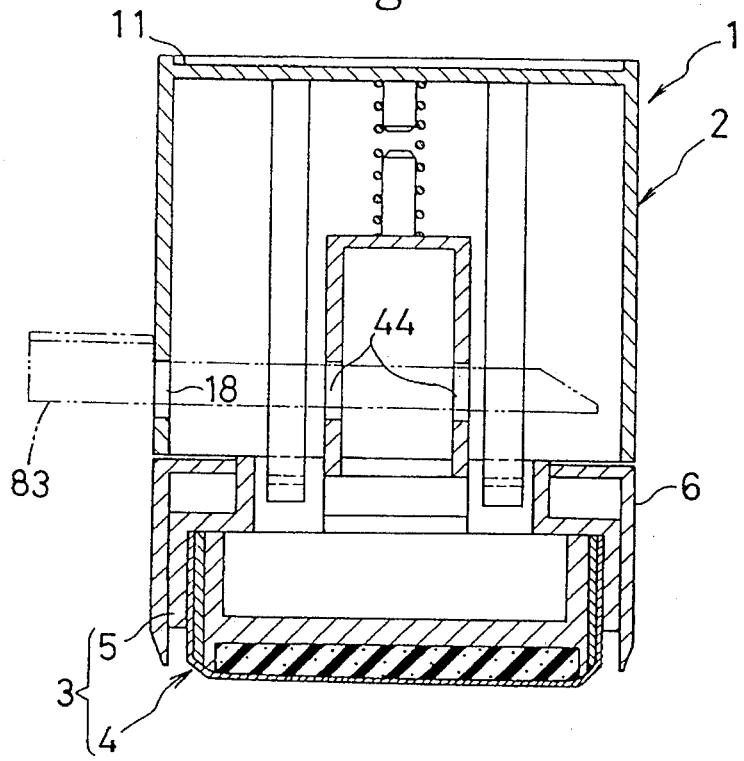
FIG. 8 is a longitudinal sectional front view of the stamp unit when the skirt member is at the third position.

When the stamp unit 1 is mounted on the perforation mount portion 71, the guide bar 83 is inserted through the guide holes 18, 44, 44 of the stamp unit 1, whereby the skirt member 6 is upwardly moved and maintained in the third position shown in FIG. 8.

The thermal perforating mechanism 72 will be described. As shown in FIGS. 13 to 22, at the lower side of the perforation mount portion 71, a guide rod 88 that extends in the right-and-left direction and guides a carriage 87 and a head switching rod 89 that extends in the right-and-left direction and operates a cam member 91 for switching the position of the thermal head 90 mounted on the carriage 87 are suspended over the right end wall 73 and the left end wall 86 of the subframe 70, and the cam member 91 is mounted on the head switching rod 89 so as not to be rotatable and so as to be freely slidable in the axial direction.

The carriage 87 is supported on the guide rod 88 and the head switching rod 89 so as to be freely movable in the right-and-left direction, and a rack 92 whose length is over the whole length of the carriage 87 is formed at the front end portion of the carriage 87.

A cam contact plate 93 and a head heat-radiating plate 94 are mounted on the carriage 87 by a shaft 95 extending in the front-and-rear direction so as to be freely slidable in the up-and-down direction. The thermal head 90 is fixed to the head heat-radiating plate 94, and the head heat-radiating plate 94 is elastically urged upwardly relative to the cam contact plate 93 by a spring 97 that is wound around a pin 96 fixed to the head heat-radiating plate 94. The cam member 91 is designed in an elliptic shape in contact with the lower surface of the cam contact plate 93. When the cam member 91 is oriented to a lateral attitude by rotating the head switching rod 89, the thermal head 90 is released downwardly together with the head heat-radiating plate 94. When the cam member 91 is oriented to an erect attitude, the thermal head 90 is upwardly shifted through the cam contact plate 93 and the spring 97 and switched to a perforation position.

At the left end portion of the head switching rod 89 is provided a gear 98 that is engaged with the sector gear 76 at the outside of the right end wall 73 of the subframe 70. When the opening and closing door 75 is opened, the cam member 91 is oriented in a lateral attitude. On the other hand, when the opening and closing door 75 is closed, the cam member 91 is switched to an erect attitude.

On the front wall 99 of the subframe 70 are provided a stepping motor 100 for driving the carriage 87, a driving gear 101 engaged with the rack 92, and a decelerating mechanism 107 for transferring the rotation of an output gear 102 of an output shaft of the stepping motor 100 to the driving gear 101. Therefore,the rotational driving force of the stepping motor 100 is transferred to the driving gear 101 while being decelerated, and thus, the carriage 87 can be driven by the stepping motor 100 to be moved in the right-and-left direction.

The thermal head 90 is the same type as a thermal printer thermal head, and the thermal head 90 is provided with heating elements 103 that are arranged on a row in the front-and-rear direction.

Next, a control system containing a control unit 110 for controlling the thermal perforating mechanism 72 and the liquid crystal display 53 will be described.

Figure 22:
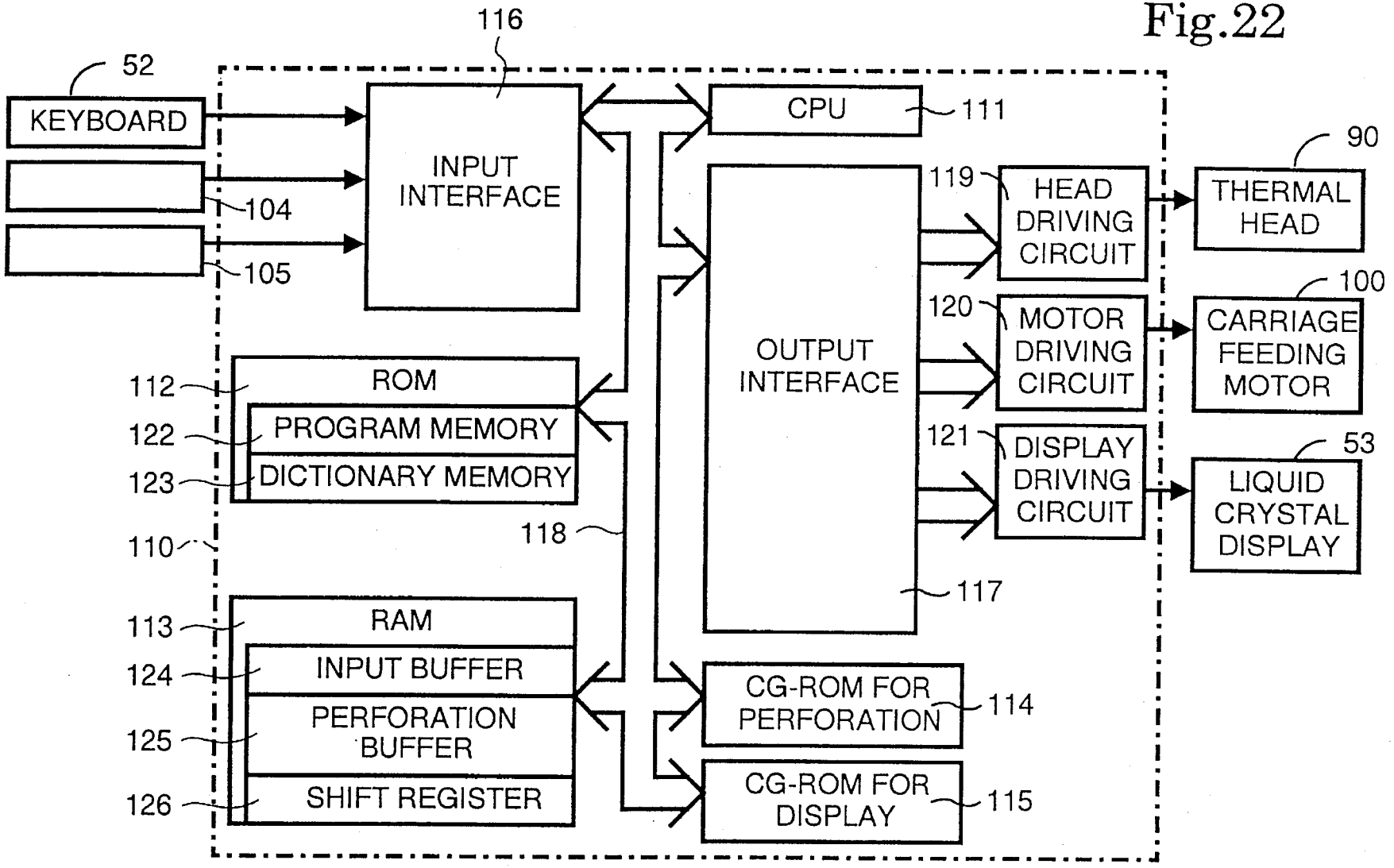
FIG. 22 is a block diagram showing a control system of the stamp device.

As Shown in FIG. 22, the control unit 110 is connected to the keyboard 52, the thermal head 90, a carriage feeding motor 100, the liquid crystal display 53, and two contactless switches for detecting presence of the stamp unit 1 and its width in the front-and-rear direction.

Figure 13:
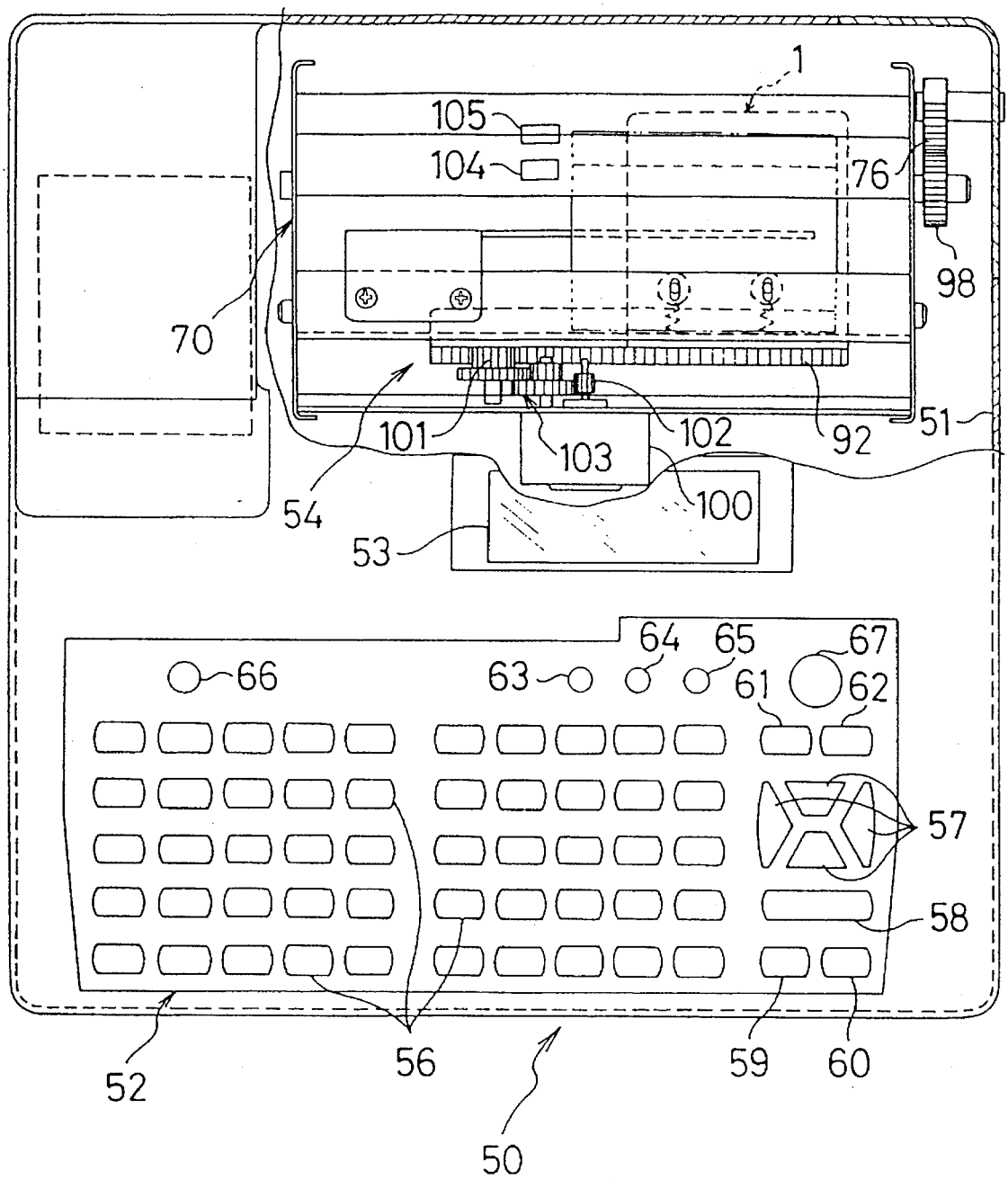
FIG. 13 is a plan partially cut-away view of the thermal perforating device.
Figure 14:
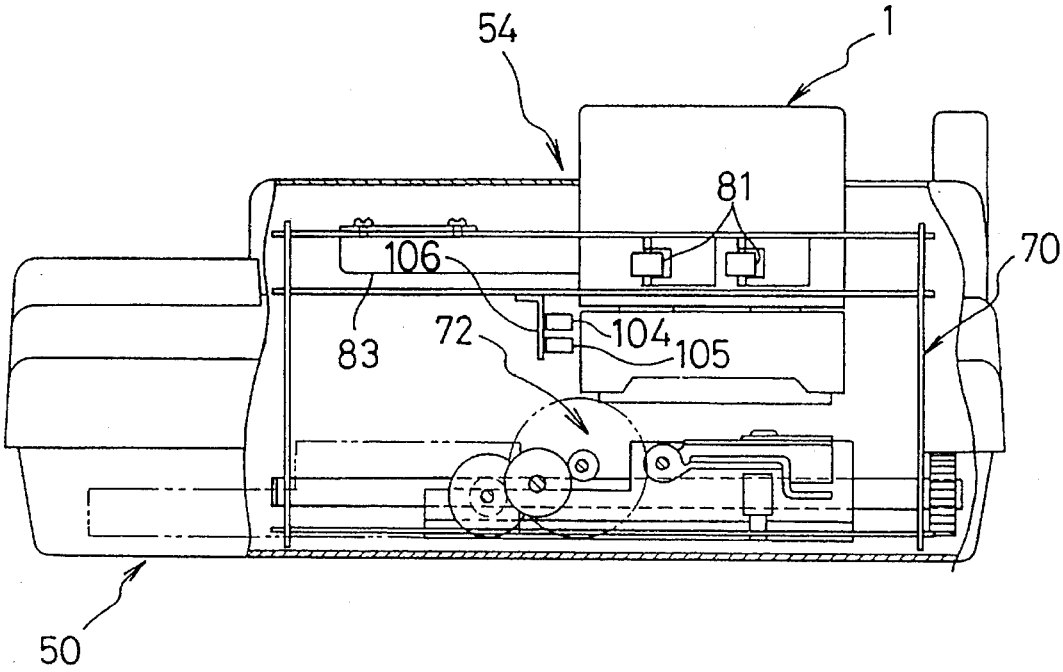
FIG. 14 is a front view of the thermal perforating device, which is partially cut away.
Figure 15:
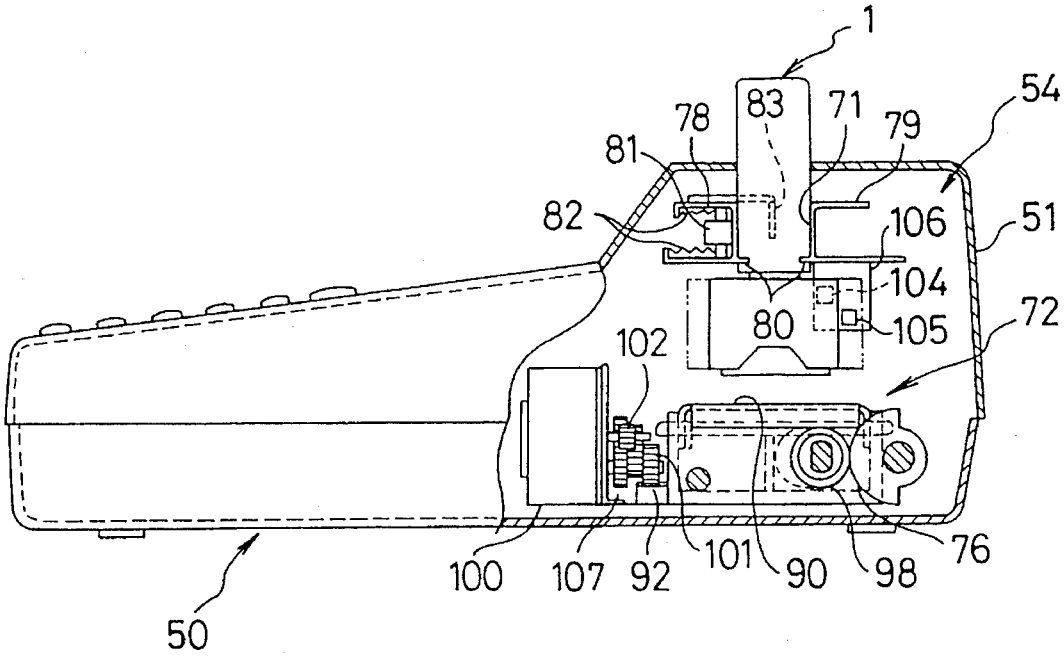
FIG. 15 is a longitudinal sectional side view of the thermal perforating device, which is partially cut-away.
Figure 19:
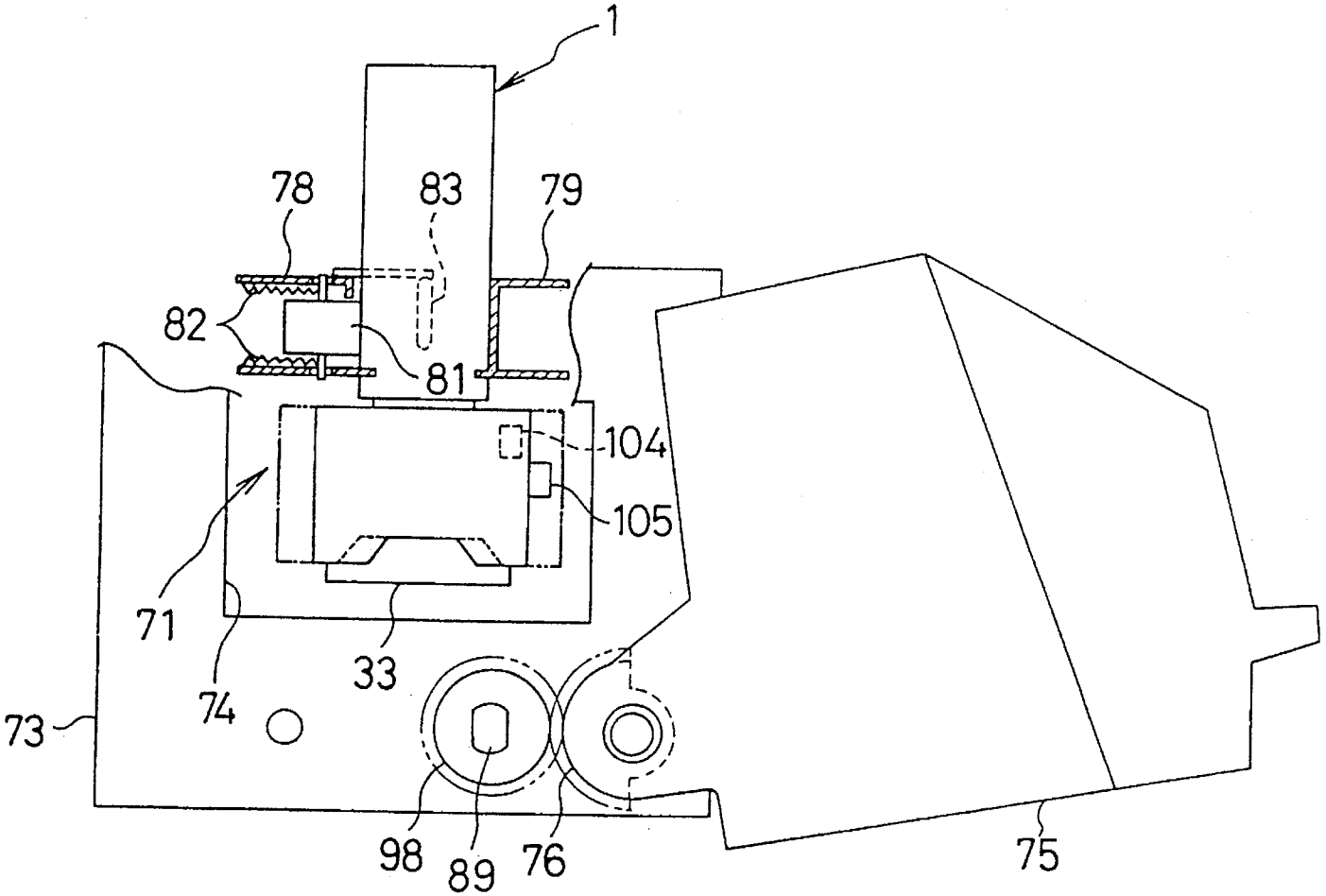
FIG. 19 is a side view of a main part of the thermal perforating unit of the thermal perforating device.

In this embodiment, as two types of the stamp unit 1 are usable, a narrow-width type is indicated by a solid line of FIGS. 15 and 19, and a wide-width type is indicated by a chain line. The two contactless switches 104 and 105 are fixed to a plate piece 106 on the lower surface of the guide member 79 at the rear side as shown in FIGS. 13, 15 and 19. A stamp unit 1 of the wide-width type is detected by the contactless switches 104 and 105, and a stamp unit I of the narrow-width type is detected by the contactless switch 104.

As shown in FIG. 22, the control unit 110 is provided with a CPU 111, a ROM 112, a RAM 113, a perforation CG-ROM 114, a display CG-ROM 115 for display on the display 53, an input interface 116 connected to the keyboard 52 and the contactless switches 104 and 105, and an output interface 117. These elements are connected to one another through a bus 118. The control unit 110 is further provided with a head driving circuit 119, a motor driving circuit 120 and a display driving circuit 121, which are connected to the output interface 117.

The ROM 112 is provided with a program memory 122 storing a control program for controlling the operation of the thermal perforating device 50 and a dictionary memory 123 for Kana/Kanji conversion, etc.

The RAM 113 is provided with an input buffer 124 for storing input data, a perforation buffer 125 for storing perforation data, a shift register 126, and other various counters and registers. The perforation CG-ROM 114 is stored with dot pattern data of many character dots serving as a perforation target in correspondence with code data, and the display CG-ROM 115 is stored with display dot pattern data of many characters serving as a perforation target.

Next, the head driving circuit 119 will be described.

Figure 23:
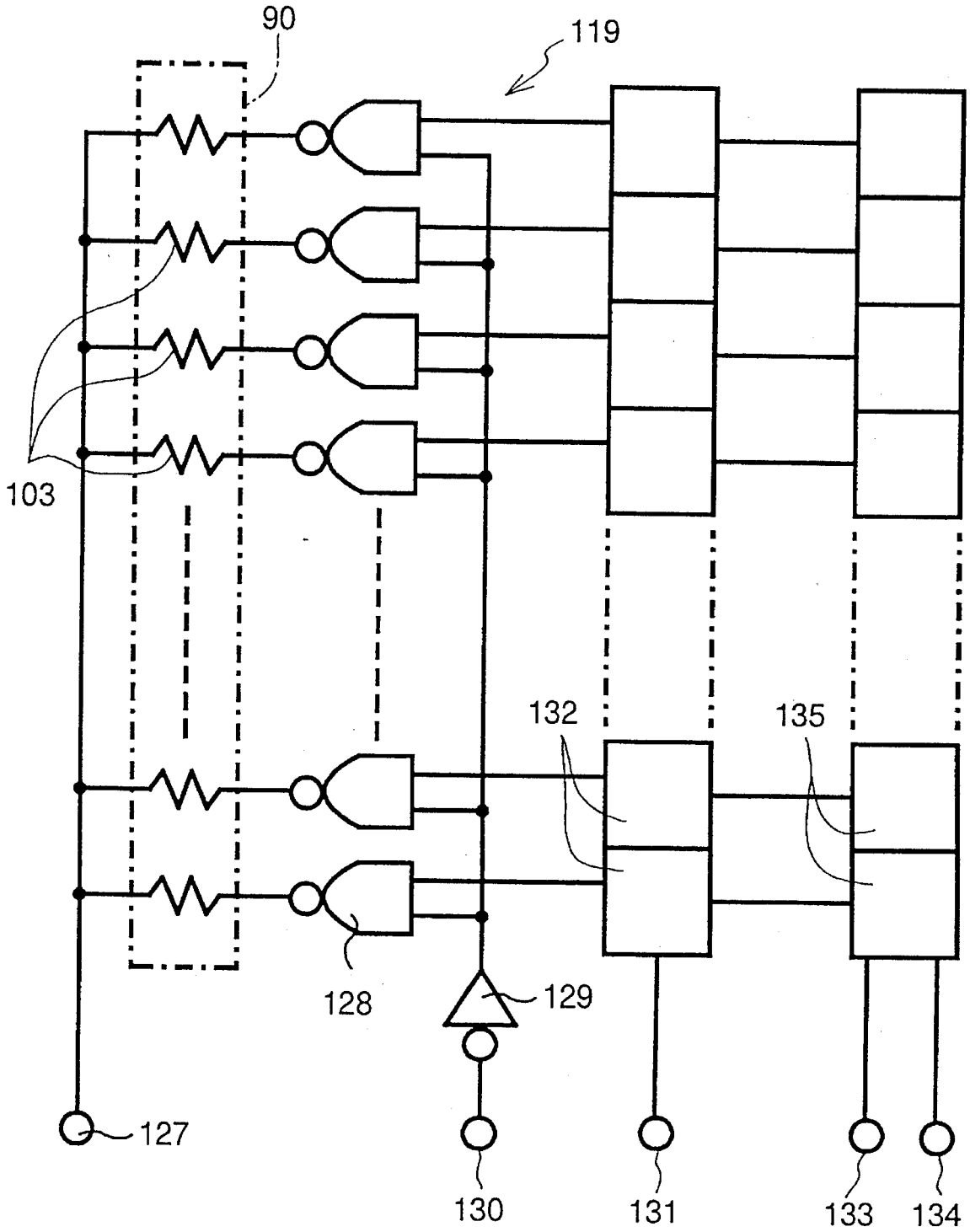
FIG. 23 is an electrical circuit diagram of a head driving circuit.
Figure 24A:
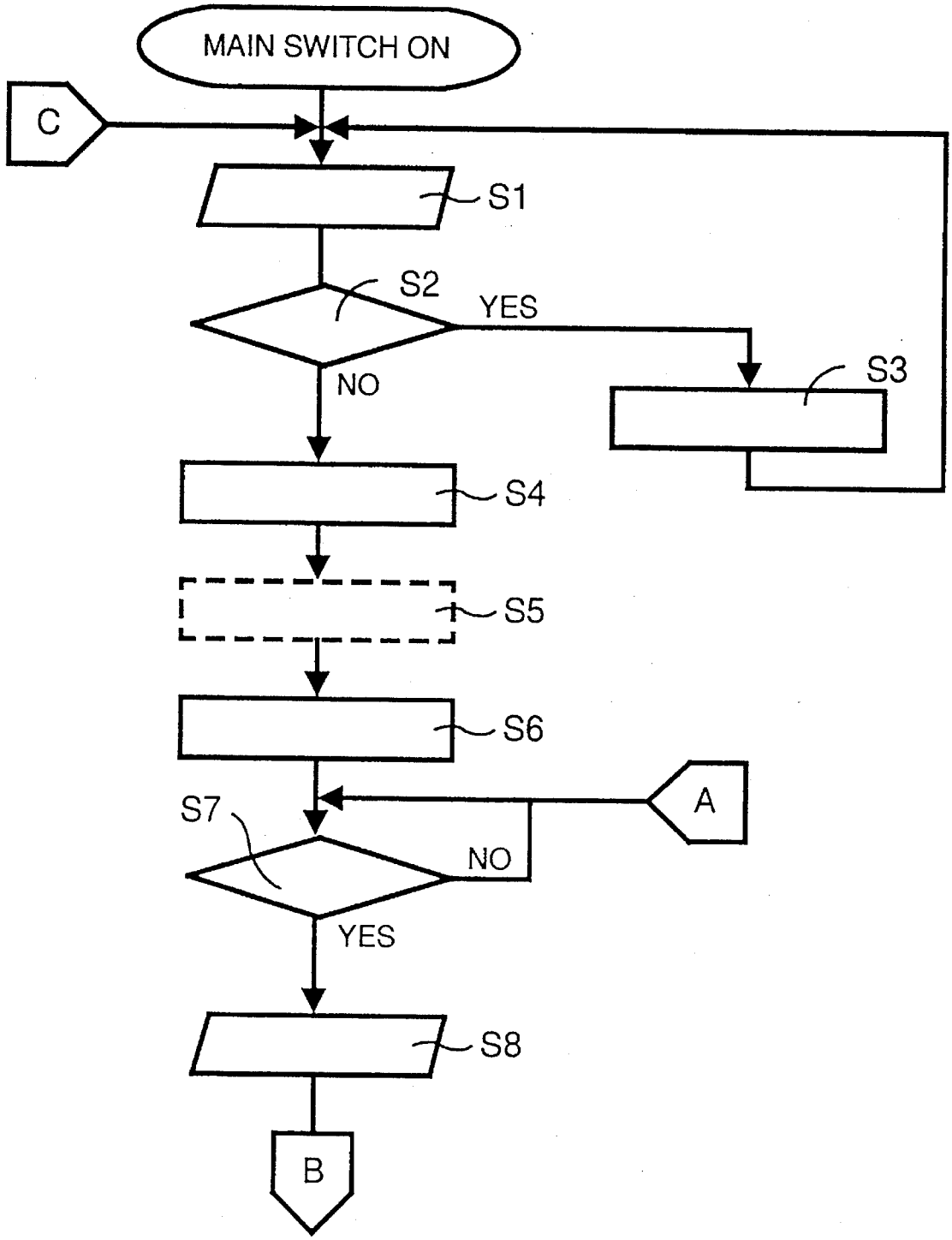
FIG. 24(A) is part of a flowchart for a perforation process by the thermal perforating device.
Figure 25A:
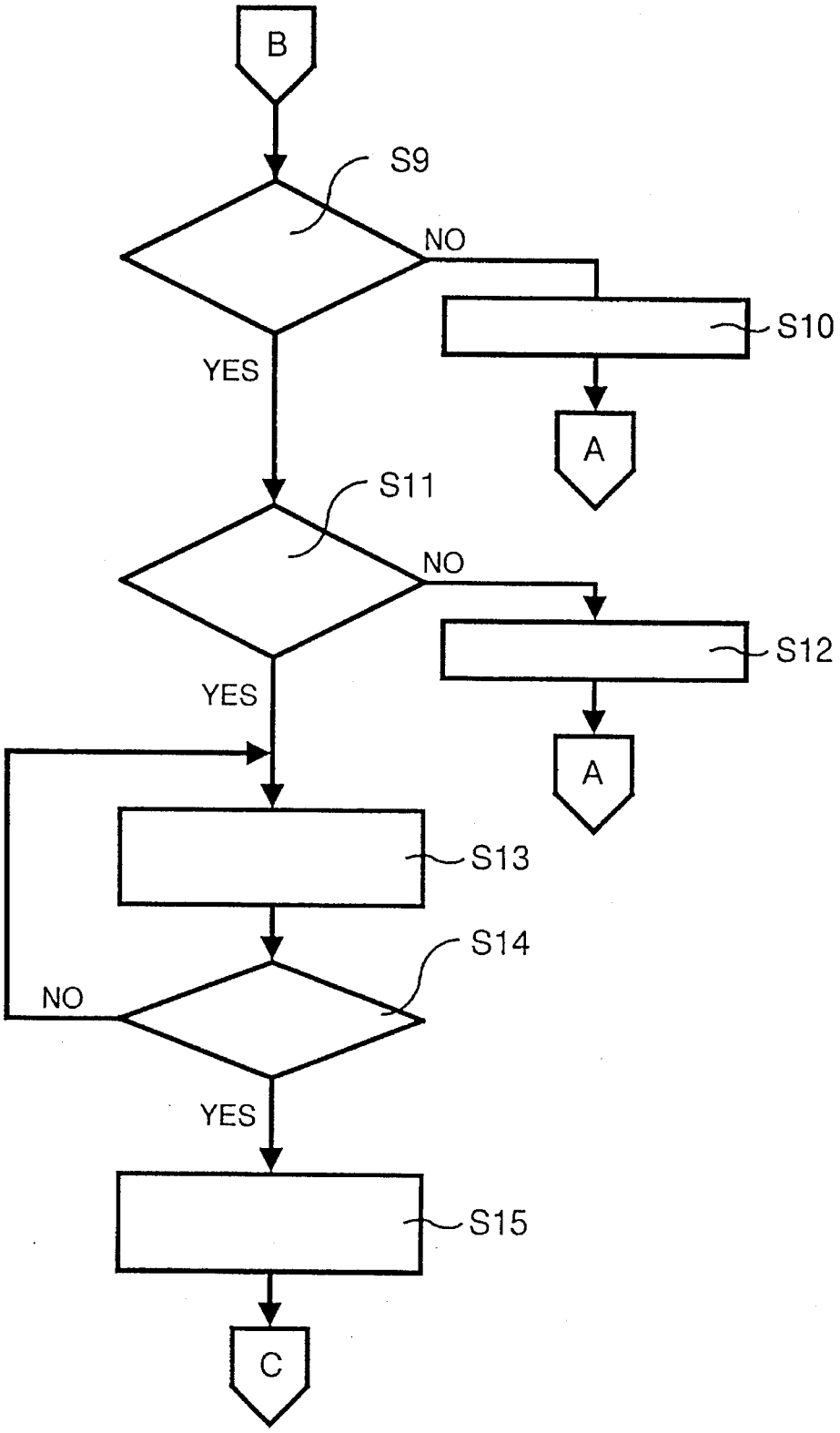
FIG. 25(A) is part of the flowchart for the perforation process by the thermal perforating device.

As Shown in FIG. 23, one electrode of each heating element 103 is connected to a power source terminal 127 of +12 V, and the other electrode is connected to each driver 128.

The input terminal of each driver 128 is connected to the output terminal of an inverter 129 whose input side is connected to a perforation stove input terminal 130, and the output terminal of each data latch circuit 132 whose input side is connected to a latch signal input terminal 131.

Further, the input terminal of each data latch circuit 132 is connected to the output terminal of each shift register 135 whose input terminal is connected to a clock input terminal 133 and a data input terminal 134.

In, the head driving circuit 119, perforation data are stored into the shift register 135 in synchronism with a clock signal. Thereafter, when a latch signal is supplied to the latch circuit 132, the data stored in the shift register 135 is output to the corresponding data latch circuit 132 and stored therein.

At the same time, the data is applied to each driver 128. When in this state a perforation pulse signal of logic "0" is applied from the perforation stove input terminal 130 to the input terminal of the inverter 128, a signal of logic "1" is output from the output terminal of the inverter 128 and applied to the input terminal of each driver 128.

Accordingly, when the data of the data latch circuit 132 is in logic "1", the output side of the driver 128 is set to logic "0", and a driving current is supplied from the power source terminal 127 to the corresponding heating element 103. At this time, the pulse width of the pulse signal input to the perforation stove input terminal 130 is set so that the surface temperature of the heating element 103 is suitable for heat perforation (e.g., 200°–300° C.).

A perforation process for perforating the print face portion 33 of the stamp unit 1 to form a pattern of a character array using the thermal perforating device 50 will be described with reference to a flowchart in FIGS. 24(A), 24(B), 25(A) and 25(B). Perforation processing contains a processing that is executed by the control unit 110 and an operation that is executed by an operator, and reference character Si (I=1, 2, 3, . . . ) represents each step.

The power-on of the main switch 67 starts processing. First, a detection signal from the contactless switches 104 and 105 is read in (S1), and it is judged Whether a stamp unit 1 exists, that is, whether the stamp unit 1 is mounted on the perforation mount portion 71 (S2). If the judgment is Yes, that is, if the power source is switched on while the stamp unit 1 is mounted on the perforation mount portion 71, a message "Please detach stamp unit" is displayed on the liquid crystal display (hereinafter referred to as LCD) 53 (S3), and the program returns to S1. Steps S1 to S3 are repetitively executed until the stamp unit 1 is detached by the operator. When the opening and closing door 75 is opened and the stamp unit 1 is detached, the judgment becomes "NO" at S2.

Subsequently, when no stamp unit 1 is mounted on the perforation mount portion 71 at the switch-on time of the power source, or when the stamp unit 1 is mounted on the perforation mount portion 71 at the switch-on time of the power source, but thereafter the stamp unit 1 is detached by the operator so that the judgment at the S2 becomes "NO", initialization is executed to clear data in the RAM 112 of the thermal perforating device 50, drive the carriage feeding motor 100 to move the carriage 87 to an initial position at the right end of the guide rod 88, etc. and "In preparation" is displayed on the LCD 53 (S4).

Subsequently, by operating the keyboard 52 at S5, the input setting of a print content is executed. In this input setting, a print-face size indication, a format input containing a character-size and a character arrangement setting, and an input of the perforation character array data into the input buffer 124 are executed.

Subsequently, a message "Please mount stamp unit" is displayed on the LCD 53 (S6), and the program waits until the perforation switch 66 is switched on (S7:No). During this period, the operator opens the opening and closing door 75 to mount the stamp unit 1 and closes the opening and closing door 75, that is, mounts the stamp unit 1 on the perforation mount portion 71.

Through the opening operation of the opening and closing door 75, the sector gear 76 is rotated in a clockwise direction (FIG. 19). The rotation of the sector gear 76 follows a counterclockwise rotation of the head switching rod 89 through the gear 98 engaged with the sector gear 76 (FIG. 19). Through this rotation, the cam member 91 mounted on the head switching rod 89 is oriented to a lateral attitude, and the thermal head 90 is released downwardly together with the head heat-radiating plate 94.

Figure 21:
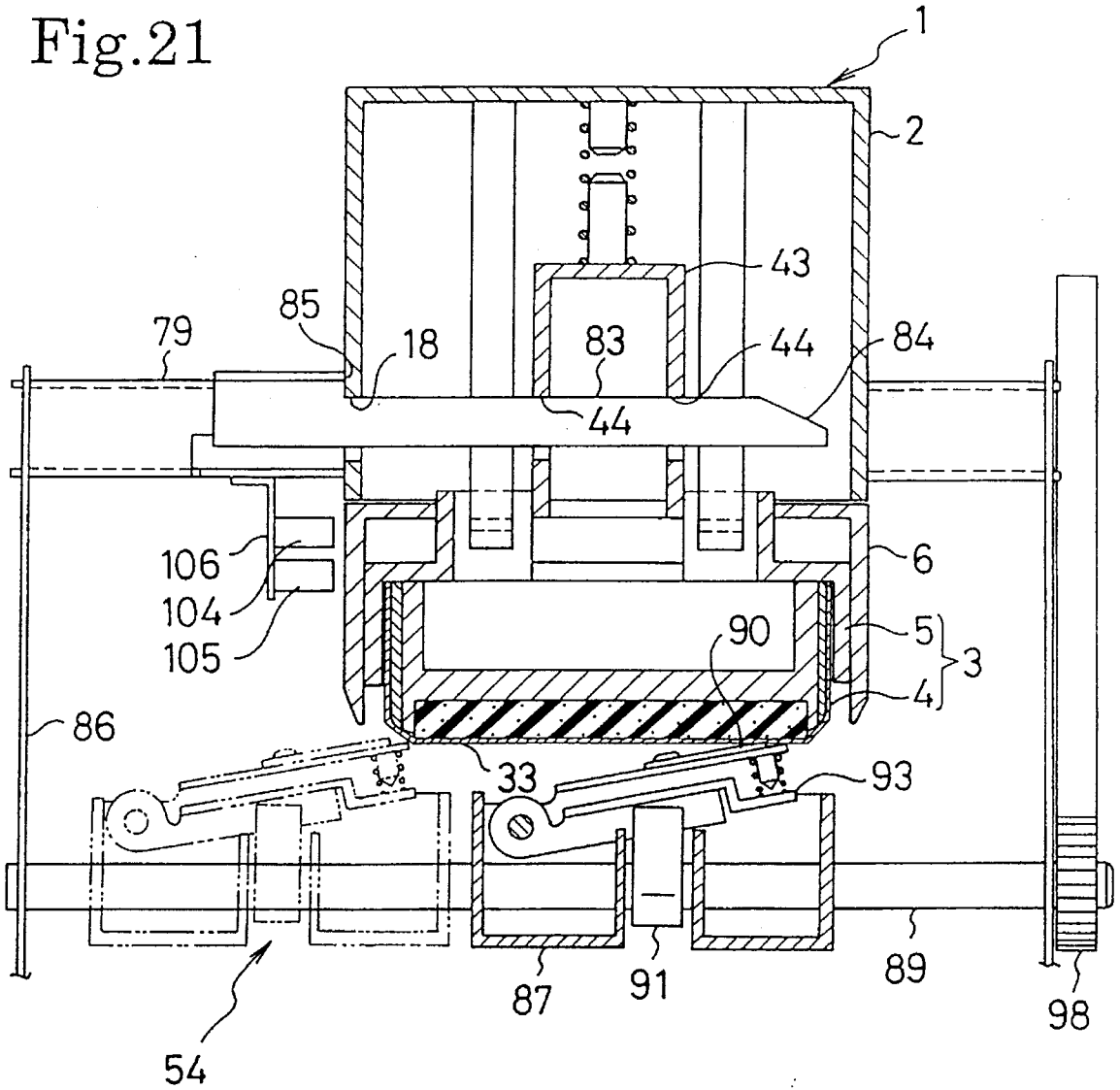
FIG. 21 is a longitudinally sectional front view of the stamp unit after mounted on the perforation mount portion and the thermal perforating unit.

The operator inserts the stamp unit 1 from the opening 74 while engagedly inserting the guide portion 80 into the guide groove 15 of the grip portion 2 of the stamp unit 1. In this insertion operation, the thermal head 90 does not interfere with the mounting of the stamp unit 1. Further, through the insertion, the guide bar 83 is inserted through the guide holes 18, 44, 44 of the stamp unit 1. Through this operation, the portal portion 43 is upwardly moved along the taper surface 84 of the guide bar 83, following the upward movement of the skirt member 6 so that the lower end thereof is elevated to a position higher than the print face portion 33 as shown in FIG. 20, and this state is maintained as shown in FIG. 21.

The operator inserts the stamp unit 1 until the stamp unit 1 abuts against the engaging portion 85 of the guide bar 83, and the right-side roller 81 fixed to the guide member 78 is engaged with the engaging recess portion 16 of the grip portion 2 of the stamp unit 1. When the insertion is made until the abutment and the engagement are completed, the stamp unit 1 is disposed at a predetermined position in the perforation mount portion 71 shown in FIG. 21.

Subsequently, the operator carries out the closing operation of counterclockwisely rotating the opening and closing door 75 (FIG. 19). Through this closing operation, the sector gear 76 rotates counterclockwisely (FIG. 19), and the rotation of the sector gear 76 follows the clockwise rotation of the head switching rod 89. Through this operation, the cam unit 91 mounted on the head switching rod 89 is oriented to an erect attitude, and the thermal head 90 is upwardly shifted through the cam contact plate 93 and the spring 97 and disposed at the perforation position at which the right end of the print face portion 33 of the stamp unit 1 as indicated by a solid line Of FIG. 21 is pressed.

The operator switches on the perforation switch 66 after mounting the stamp unit 1 as described above.

Next, upon switch-on of the perforation switch 66 (S7: Yes), the detection signals of the contactless switches 104 and 105 are read in S8, and it is judged whether the stamp unit 1 exists, that is, whether the stamp unit 1 is mounted on the perforation mount portion 71 (S9). If the judgment is Yes, that is, if the operator operates the perforation switch 66 without mounting the stamp unit 1, "Please mount stamp unit" is displayed on the LCD 53 at S10, and the program returns to S7. On the other hand, if the judgment at S9 is Yes and the stamp unit 1 is mounted, at S11 it is judged whether the print-face size set at S5 is conformable to the size of the stamp unit 1. The size of the stamp unit 1 is the width size of the stamp unit 1 that is identified on the basis of the detection signals from the contactless switches 104 and 105.

Next, if the judgment at S11 is No, that is, if the size of the stamp unit 1 is not conformable to the set print-face size, "Please substitute stamp unit" is displayed on the LCD 53 (S12), and the program returns to S7. The steps S7 to S12 are repetitively executed until the presently mounted stamp unit 1 is detached and then another stamp unit 1 whose size is conformable to the set print-face Size is mounted. On the other hand, if the judgment at S11 is Yes, that is, if the size of the mounted stamp unit 1 is conformable to the set print-face size, the perforation process is conducted on the print face portion 33 of the stamp unit 1.

During the perforation process, "Under Perforation" is displayed on the LCD 53 (S13). In the perforation process, the perforation dot pattern data are first prepared on the basis of the format input in the input buffer 124 and the perforation character-array data and stored in the perforation buffer 125. On the basis of the dot pattern data stored in the perforation buffer 125, the carriage feeding motor 100 is driven, and the carriage 87 is moved from the position as indicated by a solid line of FIG. 21 to the position as indicated by a two-dotted chain line. In addition, the thermal head 90 is driven, and pores are formed on the print face portion 33 on the basis of the perforation dot pattern data.

When the perforation process is finished, the carriage 87 is moved to a position such that the thermal head 90 is moved to the left side out of the print face portion 33, and the thermal head 90 is prevented from being continuously pressed against the print face portion 33 to induce leakage of the ink. Subsequently, it is judged at S14 whether the perforation process is finished. If the perforation is completed, at S15, "perforation process finished" and "Please detach stamp unit" are displayed on the LCD 53, and the program returns to S1. Seeing the display "Please detach stamp unit", the operator opens the opening and closing door 75 to remove the stamp unit 1. At this time, the carriage 87 is moved to the position as indicated by the two-dotted chain line of FIG. 21 So that the carriage 87 and the thermal head 90 are prevented from disturbing the detachment of the stamp unit 1.

Next, the operation of the stamp device comprising the stamp Unit 1 and the thermal perforating device thus constructed will be described.

With respect to the stamp unit 1, dot-pattern pores of a desired pattern are formed on the heat sensitive stencil paper 28 serving as the print face portion 33, the protection cap 7 is detached, and the print face portion 33 is positioned to a desired position on the surface of a sheet through the skirt member 6. Thereafter, when the operator grasps the grip portion 2 to press the grip portion 2 downwardly and press the print face portion 33 on the surface of the sheet, the ink in the impregnation member 27 oozes out through the dot pattern pores, and thus, the perforation pattern can be printed on the surface of the sheet.

The skirt member 6, which is disposed to surround the outer peripheral side of the stamp member 3, is designed to be freely upwardly and downwardly moved over the first, second and third positions. The skirt member 6 thus constructed is elastically urged toward the first position so that the print face portion 33 can be perforated to form a desired pattern in a desired dot pattern when the skirt member 6 is maintained at the third position.

In the printing operation, when the skirt member 6 is maintained at the first position and set to a print position on the surface of a sheet, the print face portion 33 is positioned, and the grip portion 2 is pressed, the spring contracts and the skirt member 6 is elevated to the second position. Therefore, the print can be accurately performed at a desired position. When the press force applied to the grip portion 2 is moderated after the print, exfoiation of the sheet from the print face portion 33 is promoted due to a returning action of the skirt member 6 to the first position so that the print can be beautifully performed on even a thin sheet. In a case where the print is performed within a narrow frame on the surface of a sheet, the print can be performed while the skirt member 6 is held by hand at the second or third position.

When the device is unused, the skirt member 6 is held at the first position by the urging force of the spring 21, the whole stamp unit 1 is supported by the skirt member 6, and the print face portion 33 can be protected.

Further, the stamp member 3 is provided with the heat sensitive stencil paper, which fixedly covers the surface portion of the impregnation member 27, and with the outer-periphery holding member 5, which surrounds the outer peripheral portion of the heat sensitive stencil paper 28 extending to the outer peripheral side of the base member 26 inside of the skirt member 6. Therefore, the outer peripheral portion of the heat sensitive stencil paper 28 extending to the outer peripheral side of the base member 26 can be prevented from being damaged by the skirt member 6, and the ink can be prevented from flowing out to the outside from the impregnation member 27.

The protection cap 7 prevents damage of the print face portion 33 and attachment of dust to the print face portion 33 when the device is unused. In addition, the protection cap 7 prevents printing at a position where print is not desired due to an erroneous operation.

With respect to the thermal perforating device 50, when the stamp unit 1 is mounted on the perforation mount portion 71, the stamp unit 1 is supported by the pair of front and rear guide portions, which are engaged with the pair of front and rear guide grooves 15 thereof, and pressed backwardly by the pair of rollers 81, whereby the position in the front and rear direction of the stamp unit 1 is accurately set.

The stamp unit 1 is secured by the engaging portion 85 and secured at the ends of the pair of front and rear guide grooves 15, whereby the position in the left-and-right direction can be accurately set. In addition, the engaging recess portion 16 of the stamp unit 1 is engaged with one roller 81, and the stamp unit 1 can be prevented from being positionally deviated during the perforating operation.

The opening and closing door 75 and the cam member 91 are interlocked with each other through the sector gear 76, the gear 98 and the head switching rod 89, and the thermal head 90 is downwardly released until the stamp unit 1 is mounted on the perforation mount portion 71 and the opening and closing door 75 is closed. Therefore, the print face 33 can be prevented from being damaged by the thermal head 90 when the stamp unit 1 is mounted. Further, when the perforation is completed, the carriage 87 is moved until the thermal head 90 is moved away from the print face portion 33 to the left side. Therefore, the thermal head 90 is prevented from continuously pressing the print face portion 33, and thus, ink leakage from the print face portion 33 can be prevented. Still further, when the stamp unit 1 is detached after perforation is completed, the thermal head 90 is downwardly released by opening the opening and closing door 75, and the print face portion 33 suffers no damage when the stamp unit 1 is taken out.

Since the skirt member 6 is switched to the most elevated third position by the guide bar 83 when the stamp unit 1 is mounted on the perforation mount portion 71, the skirt member 6 does not obstruct the perforation when the print surface portion 33 is perforated.

The width size of the stamp unit 1 is detected by the contactless switches 104 and 105, and pores of a character array that is not conformable to the size of the print face portion 33 are prevented from being formed due to an erroneous setting of the size of the stamp unit 1. Further, the stamp unit 1 is supported on the perforation mount portion 71 through the engagement between the guide member 78 and the grip portion 2 so that both of the narrow-width type of stamp unit 1 and the wide-width type of stamp unit 1 can be mounted on the perforation mount portion 71 if the grip portion is designed in the same construction. Accordingly, this device can be widely used.

In the embodiment as described above, the impregnation member 27 and the heat sensitive stencil paper 28 correspond to the stencil plate, the keyboard 52 corresponds to the input means, the thermal perforating mechanism 72 corresponds to the perforating means, the control unit 110 corresponds to the control means and the RAM 113 corresponds to the data storing means.

A part of the above embodiment may be modified as would be contemplated by those of ordinary skill in the art. For example, the perforation mount portion 71 is designed so that the stamp unit 1 is freely detachably mounted on the perforation mount portion 71 from the right side, however, it may be designed so that the stamp unit 1 is freely detachably mounted from the upper side.

The thermal perforating mechanism 72 is designed to perform the perforation while moving the thermal head 90 through the carriage 87 when the stamp unit 1 is held at a predetermined position; however, it may be designed so that the thermal head 90 is fixedly provided, and perforation is performed while moving the stamp unit 1.

In place of the cam member 91, a solenoid actuator may be provided to switch the position of the thermal head 90 using the actuator.

In place of the rack 92, the driving gear 101 and the decelerating gear mechanism 107, the carriage 87 may be moved in the right-and-left direction through a wire and a pulley.

In place of the impregnation member 27, an ink member comprising a high viscosity lump of ink may be used. The ink member may be mounted on a recess portion 25 and collected in the same shape as the impregnation member 27.

What is claimed is:

1. A stamp device, for use with a stamp unit having a grip portion, a stamp portion engageable with the grip portion having an ink member and a heat sensitive stencil paper fixedly covering the ink member to form a print face portion, comprising:

a thermal perforating unit for thermally perforating the print face portion of the stamp unit to form a dot pattern on the print face portion, wherein said thermal perforating unit comprises:

a frame, a perforation mount portion on which the stamp unit is freely detachably mounted, input means for inputting characters or symbols, data storing means for storing input data input from said input means, perforating means containing a thermal head for forming a dot pattern by perforating the print face portion of the stamp unit mounted on said perforation mount portion, and control means for receiving the input data from said data storing means to control said perforating means, wherein the stamp unit is inserted into said perforation mount portion through an opening formed on a surface of said frame, said frame further having an opening and closing means for opening and closing the opening formed on said frame, and said thermal perforating unit comprises positioning means for determining a position of the stamp unit inserted into said perforation mount portion.

2. The stamp device as claimed in claim 1, wherein said opening formed on a surface of said frame has substantially the same shape as a surface shape of a corresponding portion of the stamp unit.

3. The stamp device as claimed in claim 1, wherein said thermal perforating unit comprises a cam mechanism supported by a cam axis for switching the position of the thermal head between a printing position and a non-printing position in accordance with the opening and closing means.

4. The stamp device as claimed in claim 3, wherein said cam axis also supports the thermal head.

5. The stamp device as claimed in claim 1, wherein said thermal perforating unit comprises detecting means for detecting a size of the stamp unit inserted into said perforation mount portion.

6. The stamp device as claimed in claim 1, wherein said frame comprises an opening and closing means for opening and closing the opening formed on said frame, wherein said opening and closing means only closes the opening formed on said frame when said stamp unit is correctly inserted into said perforation mount portion in accordance with said positioning means.

7. A stamp device, for use with stamp unit having a grip portion, a stamp portion engageable With said grip portion having an ink member, a heat sensitive stencil paper fixedly covering the ink member to form a print face portion, and a skirt member surrounding an outer peripheral side of the stamp portion, wherein the skirt member is supported by at least one of the grip portion and the stamp portion so as to be upwardly and downwardly movable between a first position at which a lower end portion of the skirt member projects beyond the print face portion of the stamp portion and a second position at which the lower end portion of the skirt member does not project beyond the print face portion, comprising:

a thermal perforating unit for thermally perforating the print face portion of said stamp unit to form a dot pattern on the print face portion, said thermal perforating unit comprising:

a frame., a perforation mount portion on which the stamp unit is freely detachably mounted, input means for inputting characters or symbols, data storing means for storing input data input from said input means, perforating means containing a thermal head for forming a dot pattern by perforating the print face portion of the stamp unit mounted on said perforation mount portion, and control means for receiving the input data from said data storing, means to control said perforating means, and guide means for lifting the skirt member when the stamp unit is inserted into said perforation mount portion and the desired dot pattern is perforated on the print face portion.

8. The stamp device as claimed in claim 7, wherein the ink member is an impregnation member impregnated with ink.

9. The stamp device as claimed in claim 7, wherein a tapered face is formed on an upper surface of an end portion of said guide means.

10. The stamp device as claimed in claim 7, wherein said guide means comprises an engaging portion defining a stop for insertion of the stamp unit into said perforation mount portion.

11. The stamp device as claimed in claim 7, wherein the stamp unit further comprises a protection cap covering the print face portion of said stamp portion, the protection cap being freely detachably mounted on said stamp portion.

12. A stamp device for use with a stamp unit having a grip portion, a stamp portion engageable with the grip portion having an ink member and a heat sensitive stencil paper fixedly covering the ink member to form a print face portion, comprising:

a thermal perforating unit for thermally perforating the print face portion of the stamp unit to form a dot pattern on the print face portion, wherein said thermal perforating unit comprises:

a frame, a perforation mount portion on which the stamp unit is freely detachably mounted, input means for inputting characters or symbols, data storing means for storing input data input from said input means, perforating means containing a thermal head for forming a dot pattern by perforating the print face portion of the stamp unit nounted on said perforation mount portion, and control means for receiving the input data from said data storing means to control said perforating means, wherein said control means comprises:

means for determining whether the stamp unit is mounted for perforation at a switch-on time of a power source; and initializing means for initializing the perforating process only if the stamp unit is not mounted for perforating at a switch-on time of the power source.

13. The stamp device as claimed in claim 12, wherein said input means comprises means for inputting a print content for the stamp unit and said control means determines whether the print content is compatible with the print face portion, said control means controlling said perforating means to perforate the print face portion in accordance with the print content if the print content is compatible with the print face portion.

14. The stamp device as claimed in claim 13, wherein said control means further comprises means for determining whether a print-face size is conformable to a stamp unit size and display means for displaying an error message if the print-face size is not conformable to the stamp unit size.

15. The stamp device as claimed in claim 13, further comprising a thermal perforating mechanism including a thermal head, wherein said control means further comprises displacing means for displacing said thermal head out of contact with said print face portion after perforation.

16. A stamp device, for use with a stamp unit having a grip portion, a stencil plate engageable with the grip portion having an ink member and a heat sensitive stencil paper fixedly covering the ink member to form a print face portion, comprising:

a thermal perforating unit for thermally perforating the print face portion of the stamp unit to form a dot pattern on the print face portion, wherein said thermal perforating unit comprises:

a frame, a perforation mount portion on which the stamp unit is freely detachably mounted, an input providing for inputting characters or symbols, a data storage operatively coupled to said input, said data storage storing input data input from said input, a perforating device containing a thermal head for forming a dot pattern by perforating the print face portion of the stamp unit mounted on said perforation mount portion, and a controller operatively coupled to said input, said data storage and said perforating device, said controller receiving the input data from said data storage to control said perforating device, wherein said thermal perforating unit comprises detecting means for detecting a size of the stamp unit inserted into said perforation mount portion.

* * * * *